US011087896B2

(12) United States Patent
Crichlow

(10) Patent No.: US 11,087,896 B2
(45) Date of Patent: Aug. 10, 2021

(54) HIGH LEVEL NUCLEAR WASTE CAPSULE SYSTEMS AND METHODS

(71) Applicant: Henry Crichlow, Norman, OK (US)

(72) Inventor: Henry Crichlow, Norman, OK (US)

( * ) Notice: Subject to any disclaimer, the term of this patent is extended or adjusted under 35 U.S.C. 154(b) by 91 days.

(21) Appl. No.: 16/709,701

(22) Filed: Dec. 10, 2019

(65) Prior Publication Data

US 2021/0174980 A1 Jun. 10, 2021

(51) Int. Cl.

| | |
|---|---|
| ***G21F 5/00*** | (2006.01) |
| ***G21F 5/12*** | (2006.01) |
| ***G21F 1/08*** | (2006.01) |
| ***G21F 5/008*** | (2006.01) |

(52) U.S. Cl.
CPC ..... *G21F 5/008* (2013.01); *G21F 1/08* (2013.01); *G21F 5/12* (2013.01)

(58) Field of Classification Search
CPC ..... G21F 5/008; G21F 1/08; G21F 5/12
USPC ..... 250/505.1, 506.1, 515.1, 516.1, 517.1, 250/518.1, 519.1
See application file for complete search history.

(56) References Cited

U.S. PATENT DOCUMENTS

| | | | | |
|---|---|---|---|---|
| 5,272,741 | A | 12/1993 | Masuhara | |
| 5,850,614 | A | 12/1998 | Crichlow | |
| 5,965,829 | A | 10/1999 | Haynes | |
| 6,074,337 | A * | 6/2000 | Tucker | A61N 5/1027 600/2 |
| 6,238,138 | B1 | 5/2001 | Crichlow | |
| 7,250,119 | B2 | 7/2007 | Sayala | |
| 8,681,924 | B2 | 3/2014 | Rosenbaum | |
| 8,933,289 | B2 | 1/2015 | Crichlow | |
| 9,018,432 | B2 | 4/2015 | Farmer | |
| 9,368,243 | B2 | 6/2016 | Farmer | |
| 10,427,191 | B2 | 10/2019 | Crichlow | |
| 2013/0302650 | A1 * | 11/2013 | Delangis | G21H 1/00 429/5 |

(Continued)

OTHER PUBLICATIONS

USDoE, "Integrated Waste Management—Consent Based Siting"—(2016), Consentbasedsiting@hq.doe.gov.

(Continued)

*Primary Examiner* — Nicole M Ippolito
(74) *Attorney, Agent, or Firm* — Eric Kelly

(57) ABSTRACT

Embodiments of the present invention center around systems and methods for long-term disposal of high-level nuclear waste that is to be placed inside of particular waste-capsules that are in turn to be placed into wellbores that are located in deep-geologic-formations. Mostly or fully intact spent nuclear fuel rod assemblies may be internally packed in the waste-capsules. A given waste-capsule may include a protective-medium around the contained nuclear waste, a corrosion protective layer around the protective-medium, and a neutron absorbing and/or slowdown layer around the corrosion protective layer. The protective-medium may be in the form of a mold or injected into the waste-capsule. The protective-medium may shield against gamma radiation and protect the waste-capsule from degradation. Further, a transporter is described for surface transportion of loaded nuclear waste-capsules so that the loaded nuclear waste-capsules may be safely transported to a drilling-rig site for insertion into the wellbore.

22 Claims, 9 Drawing Sheets

(56) References Cited

U.S. PATENT DOCUMENTS

| | | | | |
|---|---|---|---|---|
| 2015/0221402 | A1* | 8/2015 | Singh | G21C 19/40 376/272 |
| 2018/0290188 | A1 | 10/2018 | Crichlow | |
| 2019/0295735 | A1 | 9/2019 | Crichlow | |
| 2019/0351467 | A1 | 11/2019 | Crichlow | |

OTHER PUBLICATIONS

US Nuclear Waste Technical Review Board, (Jan. 2016), "Technical Evaluation of the USDoE Deep Borehole Disposal Research and Development Program".

Mac Farlane A, Ewing R., "Uncertainty Underground, Yucca Mountain, and the Nation's High-Level Nuclear Waste". MIT Press, Cambridge MA. (2006).

Groat C, USGS Circular 1184, "Yucca Mountain as a Radioactive Waste Repository".

Majchrowski T et al., "Long-term corrosion of a magnesium alloy: are passive films really passive?". National Nuclear Laboratory. UK.

St. Clair et al., "Long-term behavior of simulated Partial Lead Service Line Replacements", Virginia Tech. Civil and Environmental Engineering, Blacksburg VA. Environmental Engineering Science, vol. 33, No. 1, 2016.

"Evolution of repository and waste package designs for Yucca Mountain disposal system for spent nuclear fuel and high-level radioactivewaste", Rob P.Rechard, Michael D.Voegele., Nuclear Waste Disposal Research & Analysis, P.O. Box 5800, Sandia National Laboratories, Albuquerque, NM 87185-0747,USA.

"Galvanic Corrosion of Lead by Iron (Oxyhydr)Oxides: Potential Impacts on Drinking Water Quality" Benjamin F. Trueman,† Gregory A. Sweet,§ Matthew D. Harding,§ Hayden Estabrook,† D. Paul Bishop, and Graham A. Gagnon, Department of Civil & Resource Engineering, Dalhousie University, Halifax, Nova Scotia B3H 4R2, Canada.

"Innovative Gamma and Neutron Shielding Technologies for Management of High-Level, Transuranic and Low-level Radioactive Wastes", Dash Sayala, Tri-E Radiation Technologies, LLC (United States) ; Dennis Loyd, Tri-E Radiation Technologies, LLC (United States) Waste Management Conference,Feb. 27-Mar. 3, 2005, Tucson, AZ.

"Lead and Copper Corrosion": An Overview of WRF Research, Cuppett J., Oct. 2017, Water Research Foundatuion., 6666 West Quincy Ave., Denver CO. 80235.

"Long-Term Behavior of Simulated Partial Lead Service Line Replacements", Justin St. Clair,1 Clement Cartier,2 Simoni Triantafyllidou,1 Brandi Clark,1,* and Marc Edwards,Virginia Tech, Civil and Environmental Engineering, Blacksburg, Virginia., Claro, Inc., Montreal, Canada.

"Packaging Radioactive Materials for the Nuclear Industry with High-Density Polyurethane Foams", General Plastics Manufacturing, 4910 Burlington Way, Tacoma, WA 98409. https://www.azom.com/article.aspx?ArticleID=12503.

Crichlow H., "RUNS—Retrievable Underground Nuclear Storage"—, Enercan-West Conference—Energy for a Sustainable Future, Regina, Saskatchewan, Canada, Mar. 17, 2009.

Neutron Absorber Material, Holtec International, https://holtecintemational.com/products-and-services/innovative-technologies/neutronabsorbermaterial/.

Circle Packing in a circle, Wikipedia, https://en.wikipedia.org/wiki/Circle_packing_in_a_circle.

KBS-3, Swedish Technology for High Level Radioactive Waste Disposal. https://en.wikipedia.org/wiki/KBS-3.

* cited by examiner

NOT TO SCALE 36a
34
35b
35c
35a
36
36
36
36

35b
35c
36
36
35a
36
36
36
36

35b
35c
34
36a
35a
36

35b
34
35c
35a
36
36
36
36

34
36a

HIGH LEVEL NUCLEAR WASTE CAPSULE SYSTEMS AND METHODS

CROSS REFERENCE TO RELATED PATENTS

The present application is related to previous patents by the same inventor related to the disposal of nuclear waste in deep underground formations. These United States patents are: U.S. Pat. Nos. 5,850,614, 6,238,138, 8,933,289, and 1,0427,191. The disclosures of all of these patents are all incorporated herein by reference in their entirety.

STATEMENT REGARDING FEDERAL SPONSORSHIP

This patent application is not federally sponsored.

TECHNICAL FIELD OF THE INVENTION

The present invention relates generally to disposing of nuclear waste and more particularly, to: (a) the operations of nuclear waste disposal; and (b) utilization of specialized capsules or containers for nuclear waste long-term disposal which may be sequestered in lateral wellbores drilled into deep geologic formations, such that, the nuclear waste is disposed of safely, efficiently, economically and in addition, if required, may be retrieved for technical or operational reasons.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Today (circa 2019) there is an enormous quantity of nuclear waste accumulating across the Earth. In the US alone there are more than 70,000 metric tons (MT) of high-level solid waste (HLW) being stored in cooling pools and in concrete casks on the Earth's surface. These surface operations are very costly, typically costing hundreds of millions of dollars annually. The HLW is generally called spent nuclear fuel (SNF) and consists of thousands of nuclear fuel assemblies which have been removed from nuclear power plants. These nuclear fuel assemblies are highly radioactive and also thermally active and continue to generate sensible heat which must be safely removed by maintaining these assemblies in cooling tanks at the various terrestrial surface storage site(s). There are approximately 80,000 individual nuclear fuel assemblies being stored today in the US and about 15,000 MT being added annually. There is a significant need for new mechanisms and processes to safely long-term store (dispose of) this current surface stored radioactive waste and to sequester this SNF waste in a safe manner.

In this application "HLW" and "SNF" are used interchangeably to describe the nuclear waste products (that are often substantially solid). Also, the terms "nuclear fuel assemblies," "fuel rod assemblies," "control rod assemblies," and the like, are used interchangeably. In this application the terms "capsule" "waste-capsule," "carrier tube" and "canister" may be used interchangeably with the same meaning.

Current scientific knowledge teaches that the conversion of nuclear waste to an acceptable waste form requires either, (a) that the wastes be separated from the other constituents and processed separately, or (b) that the wastes together with the other constituents be processed together. Both processes present a variety of technical challenges. Due to the radioactivity and toxicity of the wastes, separation can be both hazardous, very expensive, and prone to human-induced accidental problems.

Management and disposal of high-level nuclear wastes is risky. HLW is toxic for a long time. As a result, there is a strong need for improved radiation shielding materials and techniques for waste container capsules so that the HLW can be safely transported and disposed of effectively.

Radiation exposure causes health issues based on: type of radiation, length of exposure, distance from exposure, type of shielding, and the like. Further, shielding technologies are a function of the following: effectiveness of radiation shield, cost, ease of application, and long-term durability.

One of the expected benefits of the embodiments taught in this patent application is the fact that the neutron absorbing medium/layer can be designed and implemented to provide the required level of radiation protection, neutron slowdown, and neutron shielding necessary. This allows the high-level waste-capsule to be removed from the cooling pools storage and to be transported to the long-term nuclear disposal wellhead for internment into the geologic repository and still provide the level of safety and security required by law. In other words, a discrete time level of protection as opposed to protection for an indefinite time, or for an extended period is necessary. In this embodiment, a just-in-time (JIT) design allows the quantity and quality of the gamma and neutron shielding to be designed and not over-designed to meet the real-world requirements of transport and protection of the HLW from the surface storage in cooling pools to the deep geologic repository.

JIT systems can use all available transport system, such as, by rail, by truck, and/or by barge that are already well-developed and are available by the nuclear industry over the last 50 years and operational today in 2019.

In the same manner, and by analogy the bank safe deposit box does not have to be of the same massive construction as the bank vault door; in a similar manner in the geologic repository, the surrounding 20,000 foot section of rock formation (as an example) which overlays the lateral wellbore provides the needed massive radiation protection for human populations on the terrestrial surface. The nuclear waste-capsule itself can be designed to meet the required safety level suitable for transport and for the short time that radiation shielding may be needed during terrestrial surface movement and transport.

There is no economic or technical need for massively competent shielding system of the nuclear waste-capsule if the shielding time and quantity of shielding is only required to remove the CRA (i.e., control rod assembly) from the terrestrial surface pool, package the CRA, transport the CRA to the repository wellhead and isolate the nuclear waste-capsule by "landing" the nuclear waste-capsule inside a deep wellbore in the waste repository deep-geological-formation.

Given that the required time to remove the package and transport the nuclear waste-capsule, an optimum interval may be five days or less. The nuclear waste-capsule can be optimally designed to allow safe transport in the short time interval of only a few days between terrestrial surface cooling pools, to remove, package and transport safely to the deep geological repository wellhead. In the event of unintended delays, the nuclear waste-capsules can be returned to some intermediate storage or even to the original terrestrial surface cooling pools for continued temporary waste storage.

Currently storing these CRAs on the terrestrial surface or in shallow burial systems in casks, is very expensive, costing several million dollars per cask unit, and furthermore, these casks are very large, reinforced concrete structures that are extremely heavy, extraordinarily difficult to transport and need robust shielding and cooling systems to minimize radiation and heat from the stored HLW. These terrestrial surface or near terrestrial surface operations do not have the benefit of tens of thousands of feet of solid radiation-absorbing rock formations between them and the terrestrial biospheres. This current patent application and various embodiments disclosed herein, utilize this type of operational data and knowledge to design and implement the nuclear waste-capsule systems that allow an optimal utilization of material, optimal operating time, and minimizes the overall cost to adequately long-term store the high-level waste.

Generally, the design and manufacturing of nuclear waste-capsule systems for nuclear waste disposal are governed by a number of prevailing factors, such as, but not limited to: (1) shielding effectiveness; (2) structural integrity and durability; (3) ease of handling and transportation; (4) high volume waste loading; (5) cost-effectiveness; (6) thermal performance; (7) health and environmental protection and political acceptability; combinations thereof; and/or the like.

In practice, thin liners of lead material used in waste storage casks and containers, are effective for shielding gamma radiation, however they are not very effective in shielding neutron radiation as additional materials are needed to absorb neutron radiation.

In one embodiment of the present patent application, borated stainless steel may be used as a neutron absorbing liner/layer in the nuclear waste capsule storage containers. However, borated steel has weak mechanical/metallurgical properties, and has the potential for cracking and breaking, rendering weak shielding capacity over a long period of time. It shall be shown that a nuclear waste-capsule carrier system taught herein has a steel wall of considerable tensile and compressive strength that has typically been used in the drilling industry where tensile strength in excess of 110,000 psi are routinely used and as such shall provide the axial and compressive strength needed to support the nuclear waste-capsules and its contents over a considerable period of geologic time and minimize the negative effects of any structural deterioration of the liner system.

Further, the bombardment of borated stainless steel by the neutrons emitted by the wastes can reduce the steel's shielding efficacy, making it unsuitable for shielding in the long term. However, by the time the neutron absorption efficacy has significantly decreased, the nuclear waste-capsule is intended to have been completely emplaced in the long lateral wellbores, surrounded by multiple concentric layers of steel and concrete, deep inside the solid matrix of the geologic repository at depths of more than 15,000 to 20,000 feet below ground in basement rock formations which are geologically closed.

In the past, continued attempts to reduce the thickness of concrete shields while maintaining the desired long-life of the nuclear waste containers have been attempted. These attempts include: the use of multi-layered structures comprising a metallic vessel with a reinforced concrete lining as an inner layer; and polymerized and cured impregnated layers as intermediate layers between the inner concrete layer and the outer metallic layer. However, none of these approaches have reduced the overall thickness of these protective zones appreciably. These composite layers have always been very thick and as such are incapable of providing a system that can be used in nuclear waste capsule design and the implementation as taught in this patent application wherein the contemplated nuclear waste-capsules have to be inserted in comparatively small diameter wellbores when compared to published underground tunnel systems.

Accordingly, it is desirable and advantageous to provide improved materials and simple techniques that offer a better, more durable and cost-effective gamma and neutron radiation shielding in nuclear waste-capsule systems.

Improved materials and techniques shall enhance the safety of handling, transportation, and long-time disposal containment of HLW as well as protect human health and environment before, during and after the long-term emplacement of the HLW capsules.

In addition, it may be desirable for such materials and techniques to have such attributes as:

(a) applicable to shield multispectral and energy flux radiation;

(b) ease of application;

(c) easy to handle variations in waste characteristics without the need for separation of incompatible wastes that do not generate secondary waste streams;

(d) be cost-effective;

(e) will not expose workers to any significant and unnecessary amount of radiation; and (f) exhibit superior performance over long times required by government regulations.

To date, and based on the prior art, in order to provide a satisfactory and economical final disposal of these nuclear/radioactive wastes, it is desirable that the wastes be processed into a final form without the hazardous and expensive step of removing the other constituents. It has been understood that the waste in this final form prevents removal of the fissile constituents of the wastes and further immobilizes the waste to prevent degradation and transport of the waste by environmental mechanisms.

Several methods for providing an acceptable final form for nuclear/radioactive waste are known in the art, including: (a) vitrification, and (b) ceramification. The cost associated with these two primary methodologies is prohibitive. Published information from the US Hanford Nuclear facility which is designed for vitrification operations has a projected cost level of $16 billion.

An additional benefit to the nuclear waste industry that is contemplated by embodiments of the present invention, is that intact fuel rod assemblies, i.e., "non-disassembled," may be used. In addition, in at least one embodiment of this invention, by using intact nuclear fuel assemblies there is no need to reinvent equipment to handle the large quantities of fuel rod assemblies currently stored in surface facilities. This is a major economic, safety, and operational benefit. It is also contemplated that other forms of HLW prepared by other waste preparation means may be used in the embodiments taught herein.

Based on the inherent shortcomings of the prior art, there exists a critical need for an effective, economical method for developing and utilizing an acceptable nuclear waste process for nuclear waste products; a process that precludes the need for all the existing expensive, time-consuming and dangerous intermediate operations that are currently being used or contemplated to render the nuclear waste in a form that eventually, still has to be buried in deep underground repositories. An approach is needed that minimizes these intermediate steps. To solve the above-described problems, the present invention provides systems and/or methods to dispose of the nuclear waste (currently accumulating on the terrestrial surface or near surface) that minimizes the intermediate and intervening operational steps of the prior art and which also translates into lower overall economic costs for nuclear waste disposal.

The novel approach as taught in this patent application provides nuclear waste disposal operations that minimizes operational processes while encouraging human and environmental safety.

There is a need in the art for embodiments of the present invention as disclosed and taught herein.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describe systems and methods for storage of nuclear waste into closed and deep-geological-formations, using waste-capsules (carrier tubes) which may contain fully and functionally intact bundles of nuclear fuels rods; and wherein in some embodiments, the given waste-capsule may comprise gamma radiation shielding and/or neutron absorbing shielding. Additionally, in some embodiments, a transporter of nuclear waste-capsules, for use in terrestrial transportation scenarios is also expressly disclosed. Methods of disposing nuclear waste in specialized capsules in underground rock formations are disclosed by the present patent invention.

The present invention is concerned with disposing of nuclear waste and, more specifically, to methods and/or systems of disposing of encapsulated nuclear waste in deep underground closed rock formations using multilateral horizontal boreholes connected to the terrestrial surface by a vertical wellbore. More specifically, the invention describes methods and systems in which a novel nuclear waste-capsule system and the attendant internment methodology are illustrated to provide effective safety and shielding from neutron and gamma-ray radiation during the operations involved in handling the HLW and inputting this waste safely into the long-term nuclear geologic waste repository.

An object of the present invention is to provide a method of disposing of nuclear waste in deep underground geologically stable and hydraulically closed rock formations.

In some embodiments, providing a waste-capsule in which the nuclear waste is further protected by a series of engineered, structural, and/or natural barriers may be utilized.

It is possible to provide methods of disposing of nuclear waste in deep closed underground rock formations wherein the design of the nuclear waste-capsule may provide several novel features which may allow for:

(a) personnel safety during surface transport of HLW;
(b) personnel safety on the terrestrial surface during drilling and disposal working operations;
(c) economic and operational efficiencies in post-processing after waste accumulation at the power plants and prior to preparation of SNF for sequestering underground; and/or
(d) long-term corrosion protection/resistance while stored underground.

In some embodiments, a method may provide an operational method for fabricating at least one nuclear waste-capsule. In this operational method the recommended tasks involved provide a more efficient methodology to allow safer, more economical, and long-lasting disposal of the nuclear waste in the deep underground repositories.

In some embodiments, a very significant existing consideration must be addressed in long-term nuclear waste disposal process. It is the eventual degradation of the physical integrity of the wellbore system components. Some mechanisms are needed to minimize the degradation. A long-lived technology system is required to guarantee within technical certainty that the HLW can be contained adjacent and within the intended closed geological repository zone.

In some embodiments, a means may be utilized that may provide for very long-lived protection from degradation and migration of nuclear/radioactive materials away from the originally stored nuclear waste material. Stratigraphic and current structural geological analysis of underground oil formations which have historically produced heavy oil and other hydrocarbons indicate that tar-like deposits have existed for millions of years and have remained essentially unchanged and intact over time. In many cases the tar-like deposits actually formed an impermeable seal that prevented fluid (e.g., water) flow across the pore structure of the rock matrix due to physical and chemical changes in the rock media. In some embodiments, such tar-like deposits may be used as protective-mediums contemplated herein.

The current invention teaches an improved engineered barrier system implemented in this application with the longest duration barrier, a protective-medium at the innermost layer of protection. That is, this protective-medium may be placed directly around the stored nuclear materials. In a naturally occurring degradation process, the degradation beginning at the outermost layer in contact with the earth continues inwards into the central core of the system.

The outer protective layers, outer cement, outer (steel) pipe, inner cement, inner (steel) pipe, in this application all will degrade over varying time horizons. Whereas, the inner-most tar-like protective-medium has been historically demonstrated in the geological record, to be an effective fluid and migration barrier for millions of years. In numerical terms, the cements and steels may degrade in 2,000 to 10,000 years, however the tar (or tar like) protective-medium enclosed around the central nuclear waste core shall be protected for hundreds of thousands of years from contact with terrestrial surface biospheres. The combination of these two features sequentially allows for hundreds of thousands of years of radioactive protection of the terrestrial surface biospheres from the effects of radionuclides in the nuclear waste materials.

These and other advantages and features of the present invention are described herein with specificity so as to make the present invention understandable to one of ordinary skill in the art, both with respect to how to practice the present invention and how to make the present invention.

The foregoing and other objects, advantages and characterizing features will become apparent from the following description of certain illustrative embodiments of the invention.

The novel features which are considered characteristic for the invention are set forth in the appended claims. Embodiments of the invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

Note that in FIG. 3A, FIG. 3B, FIG. 3C, FIG. 3D, only illustrate the relative positions of the major components. More details are fully disclosed elsewhere in this patent application.

Figure 4:
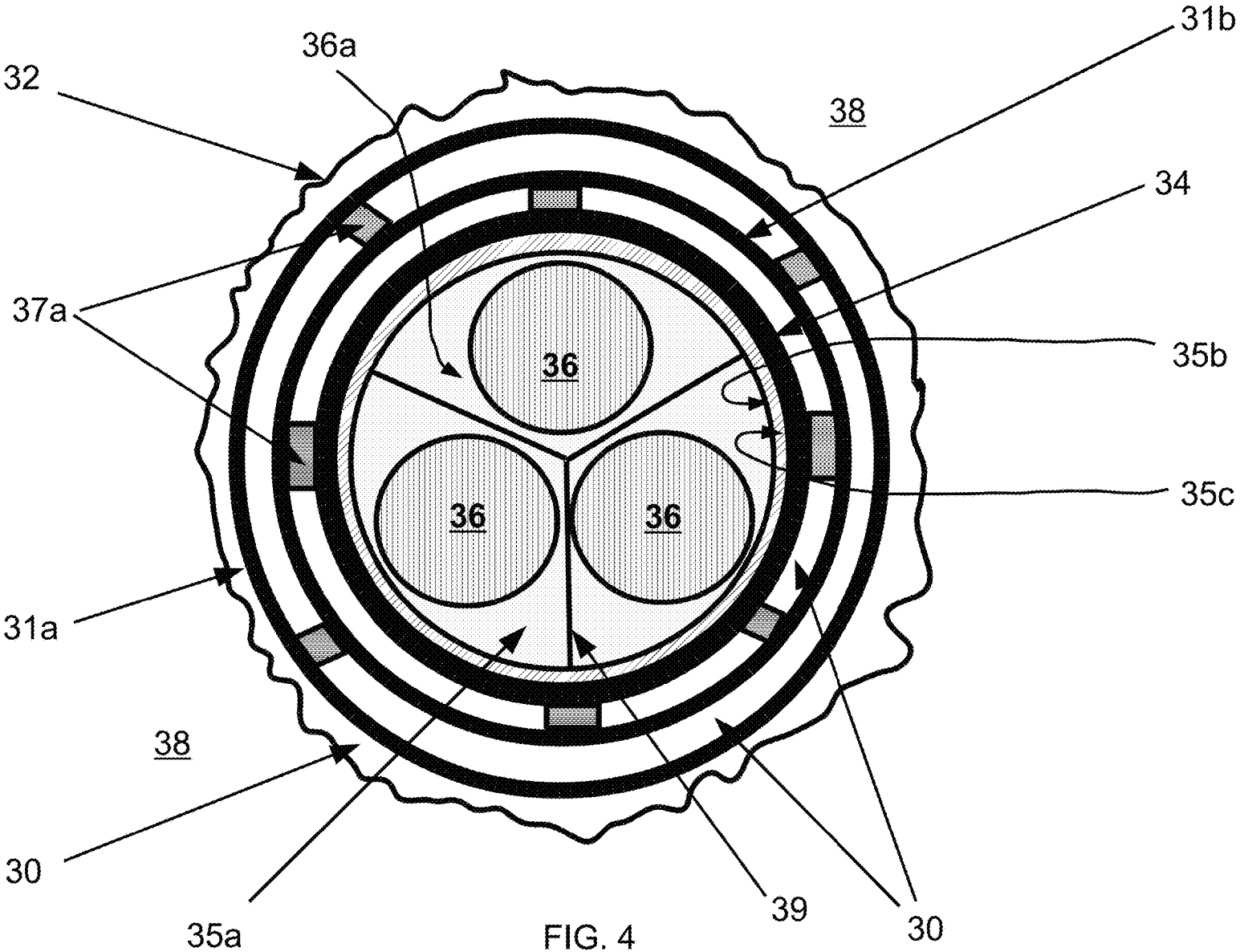

FIG. 4 may schematically illustrate a cross-section of a nuclear waste capsule and the repository rock formation in which the disposal wellbore is implemented. The FIG. 4 also illustrates at least some of the physical construction and integration of at least some of the elements of the invention, such as, but not limited to, a concentric configuration, and positioning of at least some of the various tubular elements, such as, but not limited to, the waste capsule (carrier tube), the protective-medium, nuclear fuel assemblies, other protective layers, pipes, cement, and others.

Figure 5:
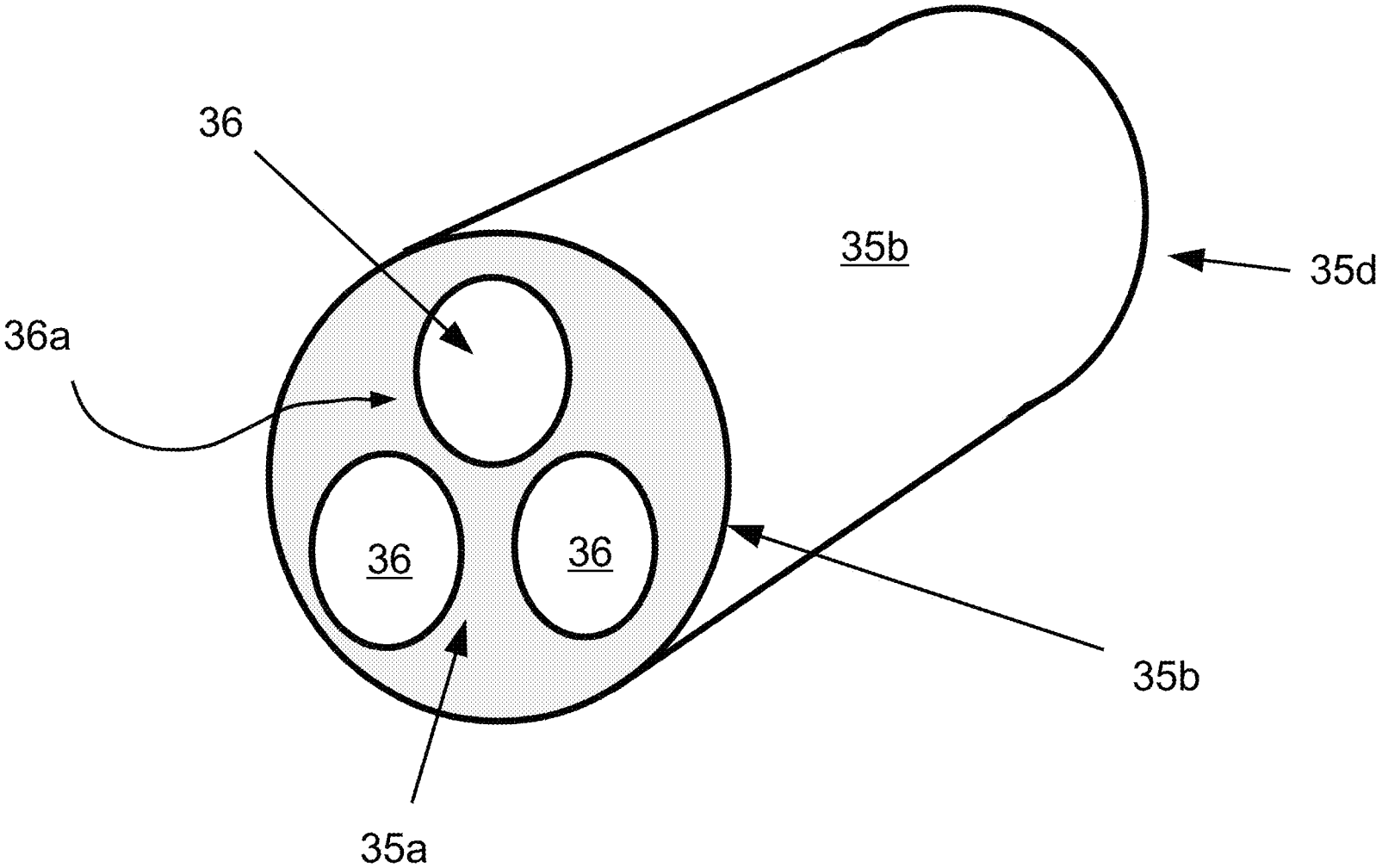

FIG. 5 may schematically illustrate a mold for receiving one or more nuclear fuel assemblies into predetermined void spaces in the mold; wherein this mold may offer/provide gamma radiation protection.

Figure 6:
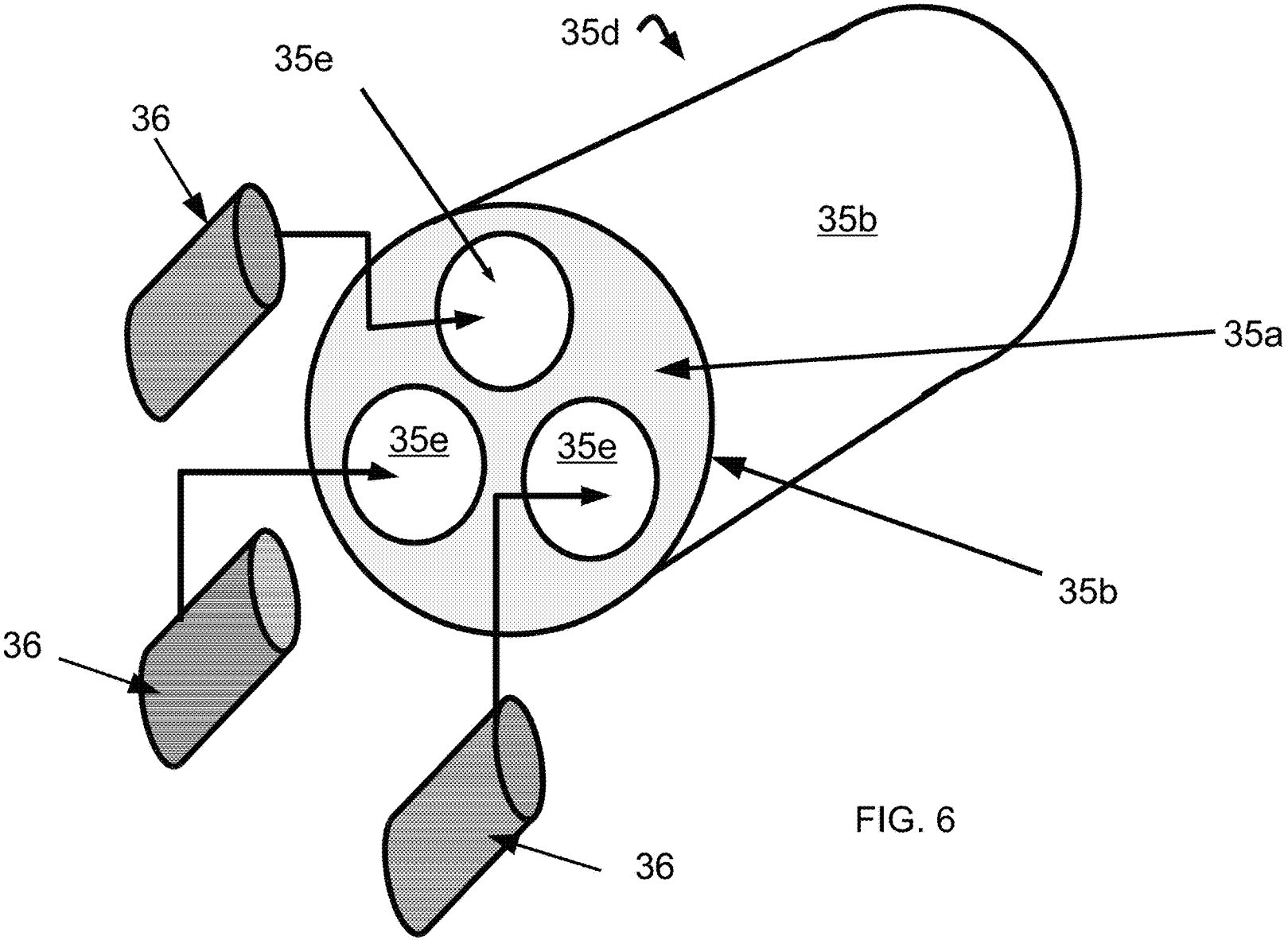

FIG. 6 may schematically show a series of three circular and cylindrical nuclear fuel assemblies (nuclear fuel bundles) being inserted into the pre-fabricated mold.

Figure 7:
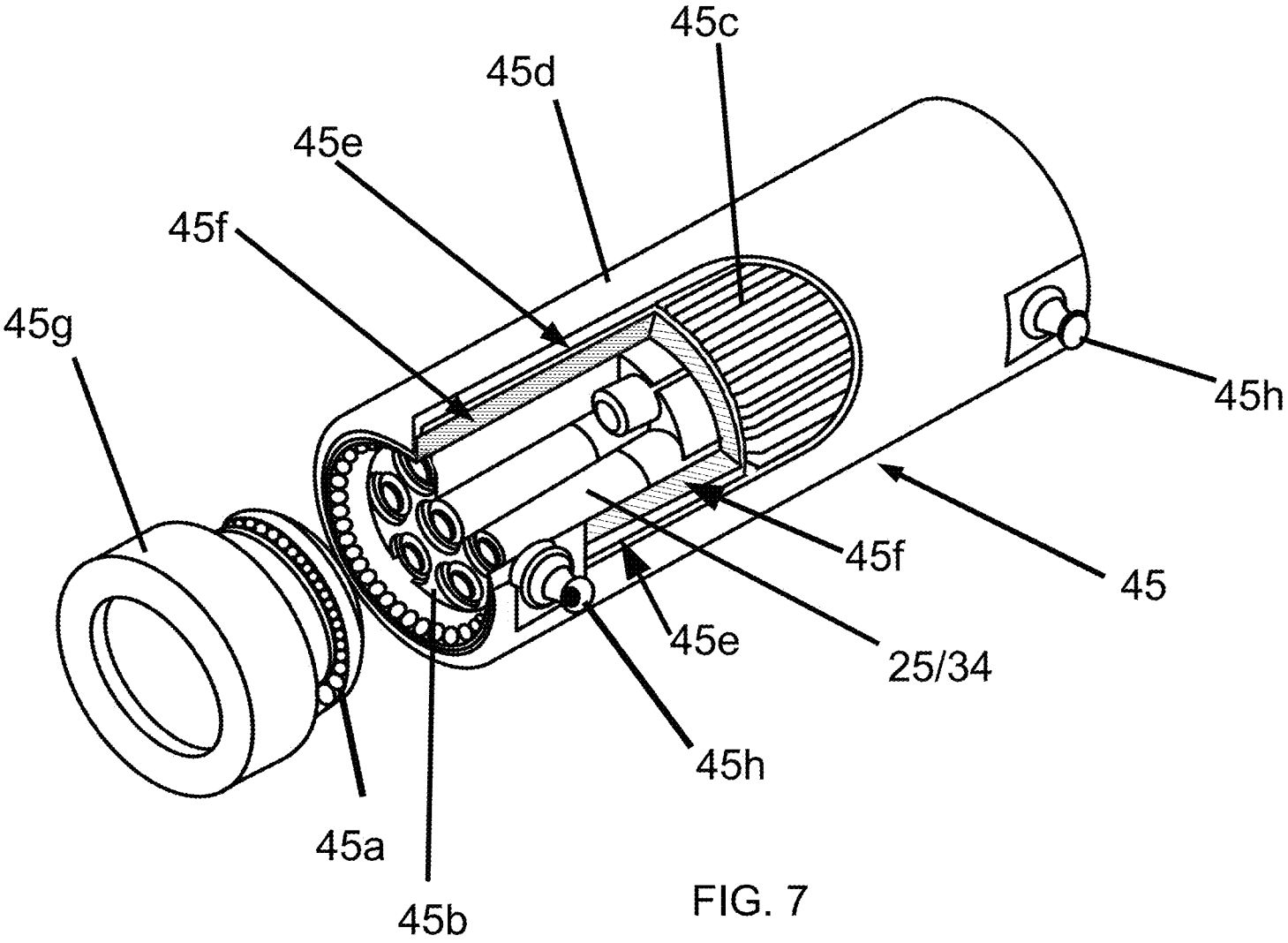

FIG. 7 may show a commercial carrier (i.e., a "transporter") used to transport the completed nuclear waste-capsules during surface transport by rail or truck.

Figure 8:
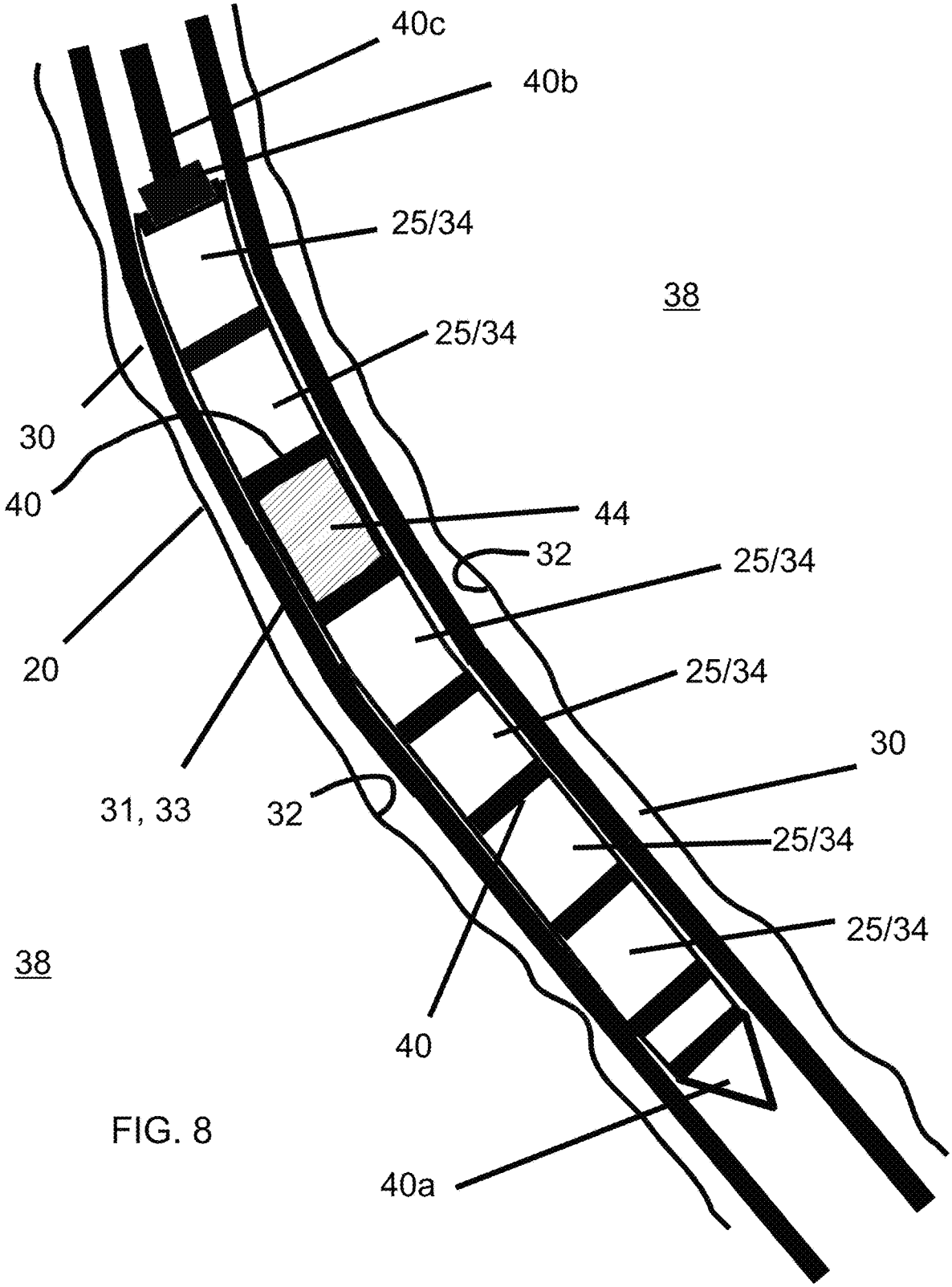

FIG. 8 may illustrate multiple capsules and connected devices which together may make up a given waste capsule string to be inserted into a given wellbore for long-term HLW/SNF storage/disposal.

Figure 9:
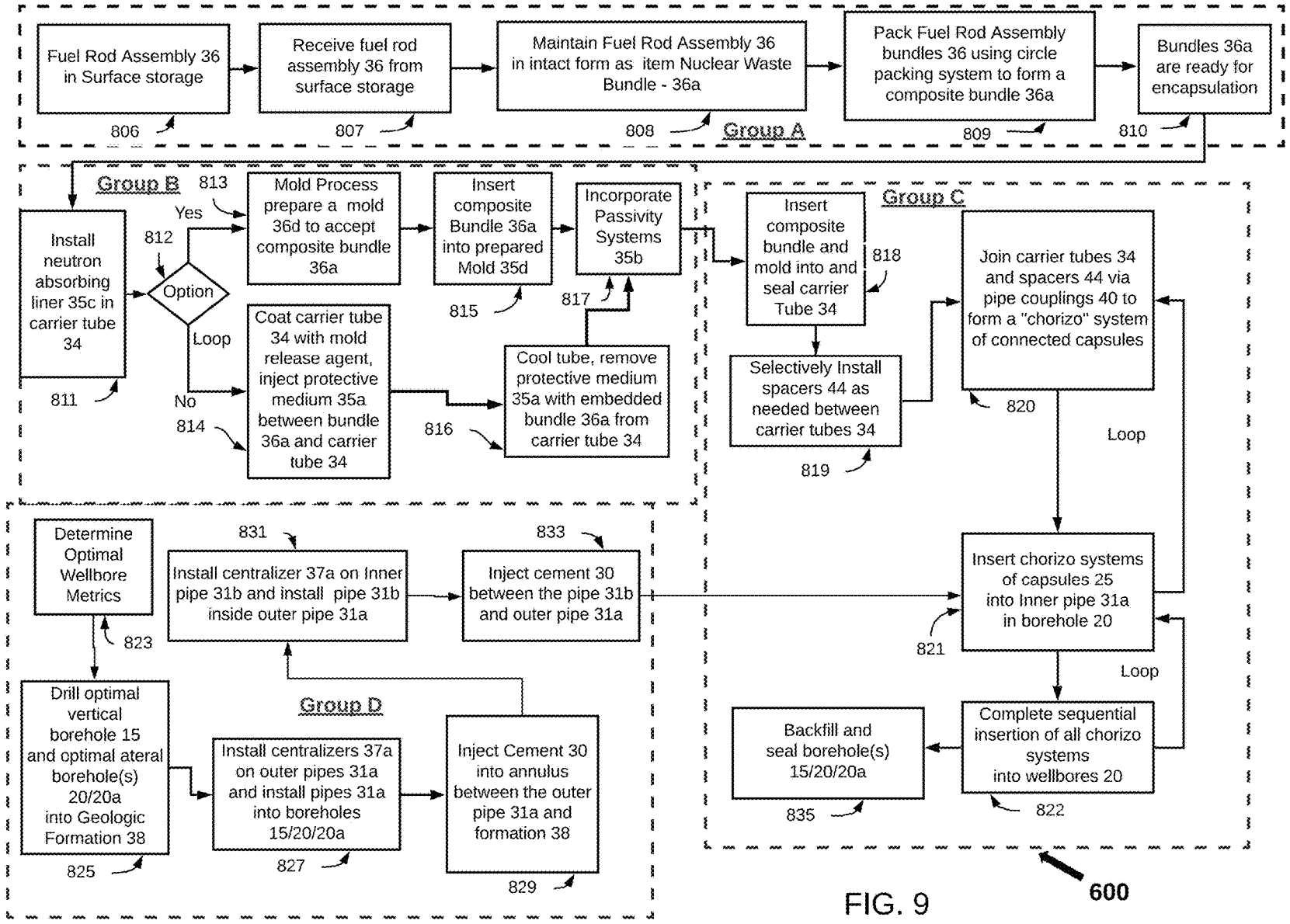

FIG. 9 is a flowchart illustrating the sequence of operations in processing the nuclear fuel rod assemblies harvested from the cooling pools and the insertion processes into the wellbores for final disposal and/or long-term storage of the HLW/SNF.

REFERENCE NUMERAL SCHEDULE

10 drilling-rig 10
10*a* nuclear power plant 10*a*
10*b* surface-storage-location 10*b*
15 vertical wellbore 15
20 primary lateral wellbore 20
20*a* secondary lateral wellbore 20*a*
25 waste-capsule 25 (for HLW and/or SNF)
30 cement 30 (e.g., annular cement layer)
31*a* pipe (casing) 31*a* (e.g., outer pipe 31*a*)
31*b* pipe (casing) 31*b* (e.g., inner pipe 31*b*)
32 wellbore-interior-surface 32
34 carrier tube 34 (for HLW or SNF)
35*a* protective-medium 35*a*
35*b* corrosion protective layer 35*b*
35*c* neutron absorbing layer 35*c*
35*d* mold 35*d*
35*e* void space 35*e*
36 fuel rod assembly (or portion thereof) 36
36*a* bundle 36*a* (e.g., bundle of fuel rods)
37*a* centralizer 37*a*
38 deep-geological-formation 38
39 support 39
40 pipe-coupling 40
40*a* landing sub tool 40*a*
40*b* detachable connector 40*b*
40*c* landing tool 40*c*
44 spacer 44 (e.g., non-waste-bearing spacer 44)
45 transporter 45
45*a* coupling 45*a*
45*b* basket 45*b*
45*c* heat conductors 45*c*
45*d* outer shell 45*d*
45*e* neutron shielding 45*e*
45*f* gamma shielding 45*f*
45*g* shock absorber 45*g*
45*h* handling attachment 45*h*
806 status of fuel rod assembly in surface storage 806
807 step of receiving fuel rod assembly from surface storage 807
808 step of maintaining intact fuel rod assembly 808
809 step of circle packing fuel assembly 809
810 step of making the fuel bundles ready for encapsulation 810
811 step of installing neutron absorbing liner in carrier tube 811

812 decision for type of protective-medium 812 (e.g., molded/cast or injected)
813 step of making protective-medium mold for bundle(s) 813
814 step of injecting protective-medium 814
815 step of inserting the bundle(s) into prepared protective-medium mold 815
816 step of cooling composite bundle 816
817 step of incorporating passivity (corrosion resistance) onto protective-medium 817
818 step of inserting protective-medium with bundle into carrier tube 818
819 step of inserting (optional) spacers as needed 819
820 step of iteratively joining several capsules to form chorizo 820
821 step of landing chorizo(s) into pipes in wellbores 821
822 step of completing the insertion of all chorizos into pipes in wellbores 822
823 step of determining wellbore system design and metrics 823
825 step of drilling (forming) boreholes 825
827 step of inserting outer casing and centralizers into boreholes 827
829 step of injecting cement between outer casing and rock 829
831 step of inserting inner pipes into outer pipes 831
833 step of injecting cement into annulus between outer pipes and inner pipes 833
835 step of sealing boreholes 835

DETAILED DESCRIPTION OF THE INVENTION

In this patent application the terms "HLW" and "SNF" describe high-level nuclear waste and may be used interchangeably herein.

In this patent application the terms "capsule," "waste-capsule," "carrier tube," and "canister" may be used interchangeably with the same meaning. For example, "waste-capsule 25" and "carrier tube 34" may be used interchangeably herein.

In this patent application the terms "tube," "pipe," and/or "casing" may refer to cylindrical elements implemented in design and/or installation processes of some embodiments of the present invention.

Note, unless an explicit reference of "vertical wellbore" or "lateral wellbore" (i.e., "horizontal wellbore") accompanies "wellbore," use of "wellbore" herein without such explicit reference may refer to vertical wellbores or lateral wellbores, or both vertical and lateral wellbores.

In this patent application the terms "wellbore" and "borehole" may be used interchangeably. In some embodiments, "initial lateral borehole 20" may be an example of a "primary lateral wellbore 20." In some embodiments, lateral borehole may be an example of "secondary lateral wellbore 20*a*" which may be substantially lateral wellbores that branch off of primary lateral wellbore 20. See e.g., FIG. 1 for primary lateral wellbore 20 and secondary lateral wellbore 20*a*. In addition, "wellbore metrics" may refer to parameters that may define a given wellbore such as, but not limited to, diameter, length, azimuth, combinations thereof, and/or the like.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1:
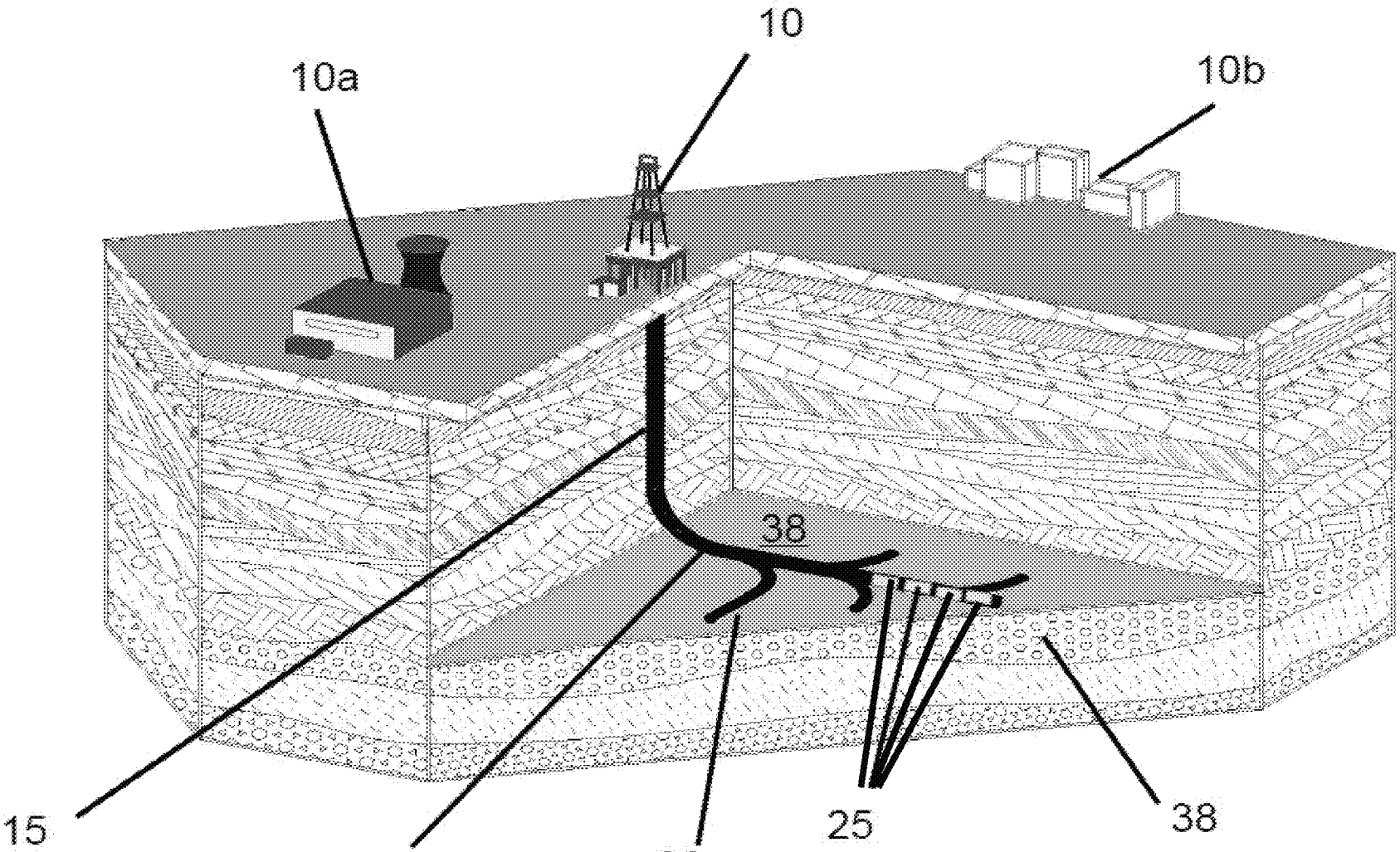
FIG. 1 shows an overview of the deep geological nuclear waste repository disposal system and its implemented wellbores and waste-capsules used therein.

FIG. 1 may illustrate an inclusive overview of the deep geologic nuclear waste disposal systems, methods, (processes), combinations thereof, and/or the like contemplated by various embodiments of the present invention. A surface drilling-rig 10 may be apparatus that drills various wellbores, such as, but not limited to, vertical wellbore 15, primary lateral wellbore 20, secondary lateral wellbore 20*a*, combinations thereof, and/or the like. In some embodiments, surface drilling-rig 10 may be used to place (locate) wellbores into deep-geological-formation 38, particularly primary lateral wellbore 20, and as needed, secondary lateral wellbore 20*a*. In some embodiments, surface drilling-rig 10 may also be used to insert (or withdraw) waste-capsule(s) 25 in the drilled out wellbores. A goal may be to place (locate) waste-capsule(s) 25, with HLW/SNF, into deep-geological-formation 38 for long-term disposal/storage. In some embodiments, surface drilling-rig 10 may also be used to insert (or withdraw) into the drilled out wellbores various tools, devices, and/or components, such as, but not limited to: landing system tool 40*c*, pipe(s) 31*a*, pipe(s) 31*b*, pipe-coupling(s) 40, landing sub tool 40*a*, cement 30, combinations thereof, and/or the like.

Continuing discussing FIG. 1, in some embodiments, deep-geological-formation 38 may be located substantially from about 5,000 feet to about 30,000 feet below a terrestrial surface, plus or minus 1,000 feet. Note, as used herein, "deep-geological-formation 38" may be used interchangeably with "repository rock formation 38." In some embodiments, deep-geological-formation 38 may be a rock formation and/or of substantially a rock formation. In some embodiments, deep-geological-formation 38 may have geologic properties that make storing nuclear materials (e.g., HLW/SNF) relatively (sufficiently) safe. For example, and without limiting the scope of the present invention, in some embodiments, deep-geological-formation 38 may have one or more of the following geologic properties: structural closure, stratigraphically varied, low porosity, low permeability, low water saturation, reasonable clay content, combinations thereof, and/or the like. For example, and without limiting the scope of the present invention, in some embodiments, primary lateral wellbore 20 may be located a predetermined depth of at least 10,000 feet below the (terrestrial) surface. In some embodiments, waste-capsule 25 may store (e.g., contain) HLW (high-level solid waste) and/or SNF (spent nuclear fuel). Associated usually, but normally at distant remote locations, may be one or more nuclear power plant(s) 10*a*; and/or one or more surface-storage-location(s) 10*b* for nuclear waste storage. Both nuclear power plant(s) 10*a* and/or surface-storage-location(s) 10*b* may be located on a terrestrial surface. In some embodiments, drilling-rig 10 may be substantially as a drilling rig used in the oil-well drilling industry but with several updated modifications and features to allow safe handling of the radioactive waste (such as, HLW and/or SNF).

In some embodiments, waste-capsule 25 may comprise two opposing terminal ends. In some embodiments, waste-capsule 25 may be an elongate member. In some embodiments, waste-capsule 25 may be a substantially cylindrical member. In some embodiments, waste-capsule 25 may be rigid to semi-rigid.

Continuing discussing FIG. 1, in some embodiments, while at least some portions of vertical wellbore 15 may be substantially vertical with respect to terrestrial surface of the earth, at least some portions of primary lateral wellbore 20 may be substantially horizontal. In some embodiments, one or more primary lateral wellbores 20 may emanate (e.g., derive/branch off) from vertical wellbore 15. In some embodiments, one or more secondary lateral wellbores 20*a* may emanate (e.g., derive/branch off) from primary lateral wellbores 20. In some embodiments, one or more waste-capsules 25 may be located, placed, and/or stored in one or more of primary lateral wellbores 20, secondary lateral wellbores 20*a*, and/or vertical wellbores 15. In some embodiments, drilling-rig 10 may be used to form one or more of vertical wellbores 15, primary lateral wellbores 20, and/or secondary lateral wellbores 20*a*.

In some embodiments, one or more of vertical wellbores 15, primary lateral wellbores 20, and/or secondary lateral wellbores 20*a* may have predetermined diameters. For example, and without limiting the scope of the present invention, in some embodiments such wellbore diameters may be selected from the range of substantially six inches to substantially 48 inches, plus or minus one inch.

In some embodiments, one or more of vertical wellbores 15, primary lateral wellbores 20, and/or secondary lateral wellbores 20*a* may have predetermined lengths. For example, and without limiting the scope of the present invention, in some embodiments such lengths may be selected from the range of substantially five hundred feet to substantially twenty-five thousand feet, plus or minus five feet.

Some embodiments of the present invention may be focused on utilizing the least number of intermediary steps (e.g., preprocessing steps) in moving HLW and/or SNF from nuclear power plant(s) 10*a* to wellbores within deep-geological-formation 38; and/or from surface-storage-location (s) 10*b* to wellbores within deep-geological-formation 38.

Figure 2C:
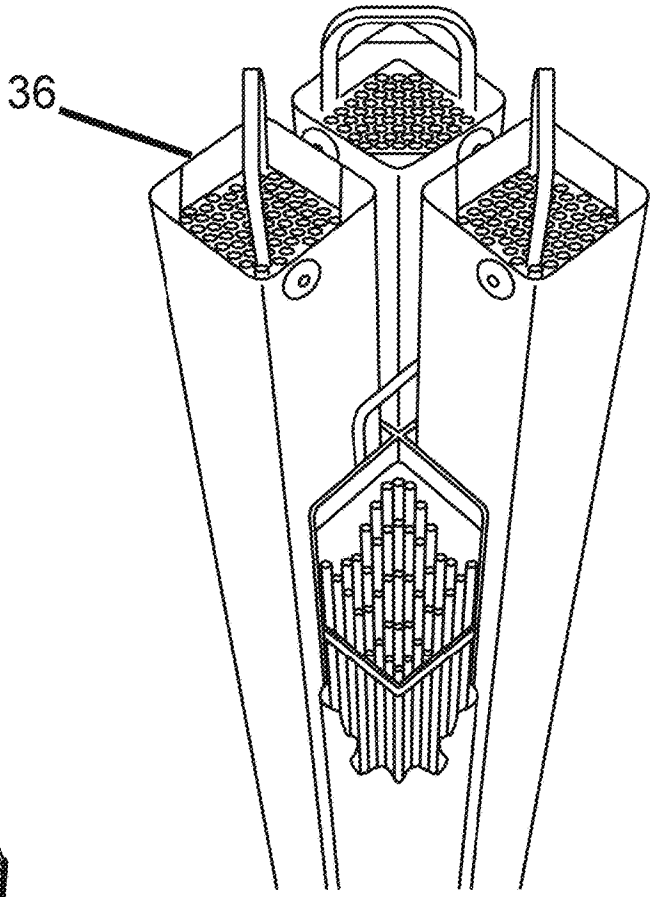
FIG. 2C (Prior Art)
FIG. 2C (Prior Art) may show a generally rectilinear fuel rod assembly.
Figure 2B:
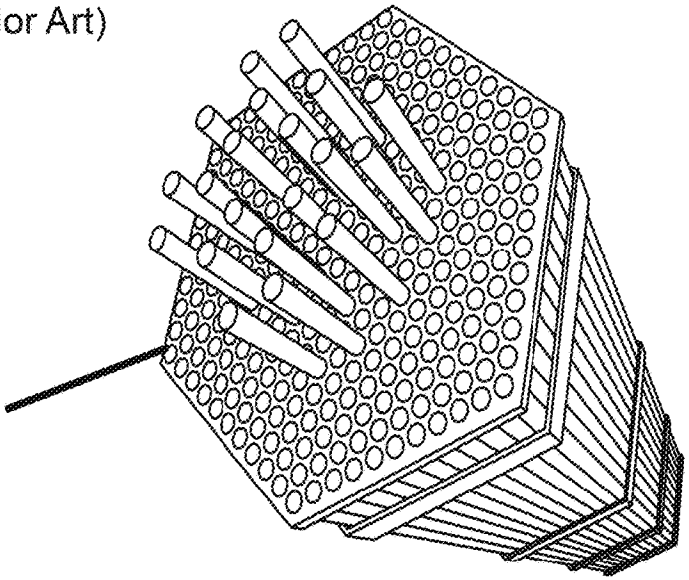
FIG. 2B (Prior Art)
FIG. 2B (Prior Art) may show a generally hexagonal fuel rod assembly.
Figure 2A:
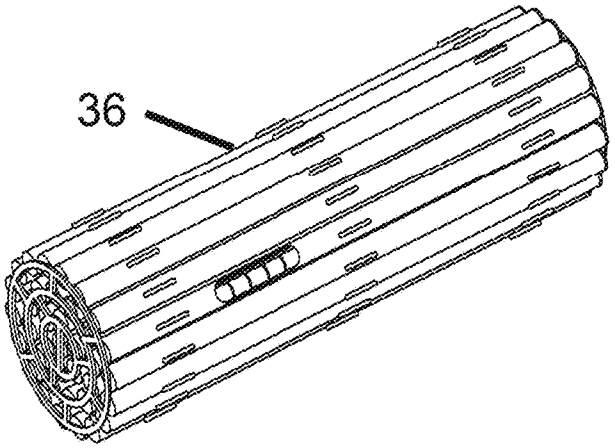
FIG. 2A (Prior Art)
FIG. 2A (Prior Art) may show a generally cylindrical fuel rod assembly.

FIG. 2A, FIG. 2B, and FIG. 2C may collectively illustrate types of nuclear fuel assemblies 36 currently used in/at nuclear power plant(s) 10*a*. FIG. 2A, FIG. 2B, and FIG. 2C may be prior art. These nuclear fuel assemblies 36 may vary in size and shape in actual practice, but generally with fixed, finite, and known dimensions; and may have been specifically designed to optimize performance during power generation. In general practice today, the nuclear fuel assemblies 36 are circular, hexagonal or square in cross-section. Some nominal dimensions of these types of nuclear fuel rod assemblies 36 may be as follows: (a) square or rectilinear types are usually between 4 meters to 5 meters in length and about 14 cm to 22 cm in cross-section; and (b) nominal dimensions of the cylindrical fuel rod assemblies are about 50 cm long and about 10 cm cross-section. Dimensions and geometries of nuclear fuel assemblies 36 are precisely known and predetermined. During and after use, nuclear fuel assemblies 36 may contain HLW and/or SNF. At least one objective of the present invention may be to store (dispose of) nuclear fuel assemblies 36 (and/or portions thereof) with HLW and/or SNF in waste-capsule(s) 25 that are placed (located) in wellbores (e.g., 15/20/20*a*) within deep-geological-formation 38.

Note "nuclear fuel assembly 36" as used herein may also refer to a portion of an entire/intact nuclear fuel assembly. For example, and without limiting the scope of the present invention, portions of an entire nuclear fuel assembly 36 may be required to be cut/disassembled into smaller portions for insertion into a given waste-capsule 25. Note, in such instances, the cutting and/or disassembly may be done without breaching a given rod with HLW and/or SNF.

FIG. 3A, FIG. 3B, FIG. 3C, and FIG. 3D may illustrate various types of circle-packing operations in which nuclear fuel assemblies 36 may be optimally inserted into generally circular and cylindrical capsule carrier tubes 34 which may then hold these nuclear fuel assemblies 36. Note, in the figures, bundle 36*a* may refer to two or more nuclear fuel assemblies 36. In some embodiment, a given carrier tube 34 may house/hold at least one bundle 36*a*; and that at least one bundle 36*a* may be of two or more nuclear fuel assemblies 36. Note, in some embodiments, bundle 36*a* and nuclear fuel assembly 36 may be used interchangeably. In some embodiments, such nuclear fuel assemblies 36 packed within a given carrier tube 34, may be intact (non-disassembled). In this application, surrounding the fuel assemblies 36 may be a protective-medium 35*a*. In some embodiments, protective-medium 35*a* may be implemented by a variety of materials which provide a combination of protective properties in the disposal process. In addition, a corrosion protective layer 35*b* may be implemented on the outside of this protective-medium 35*a*. This corrosion protective layer 35*b* may be implemented between protective-medium 35*a* and the capsule carrier tube 34 as a physical layer. In some embodiments, corrosion protective layer 35*b* may be implemented between protective-medium 35*a* and a neutron absorption layer 35*c* (in some embodiments, neutron absorption layer 35*c* may be located on an inside of carrier tube 34 as a physical layer). In some embodiments, corrosion protective layer 35*b* and neutron absorption layer 35*c* may be concentric "sheaths" together protecting from gamma radiation and neutron emission/transmission. In some embodiments, corrosion protective layer 35*b* may be a substantially thin layer. In some embodiments, corrosion protective layer 35*b* may be sprayed, dipped, painted, wrapped, combinations thereof, and/or the like, onto an exterior of protective-medium 35*a*.

Note, a surface needing protection may be the surface of protective-medium 35*a*. Over geologic time, carrier tube 34 may corrode due to breakdown of the annular cement layer(s) 30 and the presence of interstitial brines in deep-geological-formation formation 38 which may initiate external corrosion of carrier tube 34. However, passivity of corrosion protective layer 35*b* which may be inside carrier tube 34, thus protects the inner protective-medium 35*a* from corrosion degradation and thus ultimately also protects the fuel rod assembly 36 within protective-medium 35*a*.

Without some form of corrosion resistance, protective-medium 35*a* may be at risk of degradation and/or damage from corrosion. Encapsulating protective-medium 35*a* within a substantially thin layer of corrosion protective layer 35*b* has been found to provide necessary corrosion resistance and to do so without having encapsulating protective-medium 35*a* in a less than desirable thick layer. It has been increasingly found that the level of passivity in corrosion protective layer 35*b* is not necessarily related to the formation of voluminous scales that may seemingly block exterior surfaces of protective-medium 35*a*. The formation of a thin corrosion protective layer 35*b* that hinders the electronic exchange between metal and the oxidant may simultaneously slow the transport of oxidized metal to the surface of protective-medium 35*a* and may cause significant passivity. Alternatively, one of the several monolayers formed as a result of strong absorption of specific corrosion inhibitors may be enough to virtually stop corrosion in an otherwise corrosive environments that may exist in the disposal zone (e.g., within a given wellbore 15/20/20*a* within deep-geological-formation 38).

In some embodiments, carrier tube 34 may comprise two opposing terminal ends. In some embodiments, carrier tube 34 may be an elongate member. In some embodiments, carrier tube 34 may be a substantially cylindrical member. In some embodiments, carrier tube 34 may be an elongate cylindrical member. In some embodiments, the elongate cylindrical member of carrier tube 34 may have two opposing terminal ends that are sealable, such that a volume within carrier tube 34 is completely sealed off from an external environment. In some embodiments, carrier tube 34 may be rigid to semi-rigid. In some embodiments, carrier tube 34 may be a structural member. In some embodiments, carrier tube 34 may be substantially constructed from at least one type of metal or metal alloy. In some embodiments, carrier tube 34 may be substantially constructed from at least one type of steel. In some embodiments, carrier tube 34 may be substantially constructed from steel.

Figures 3A, 3B, 3C, 3D:
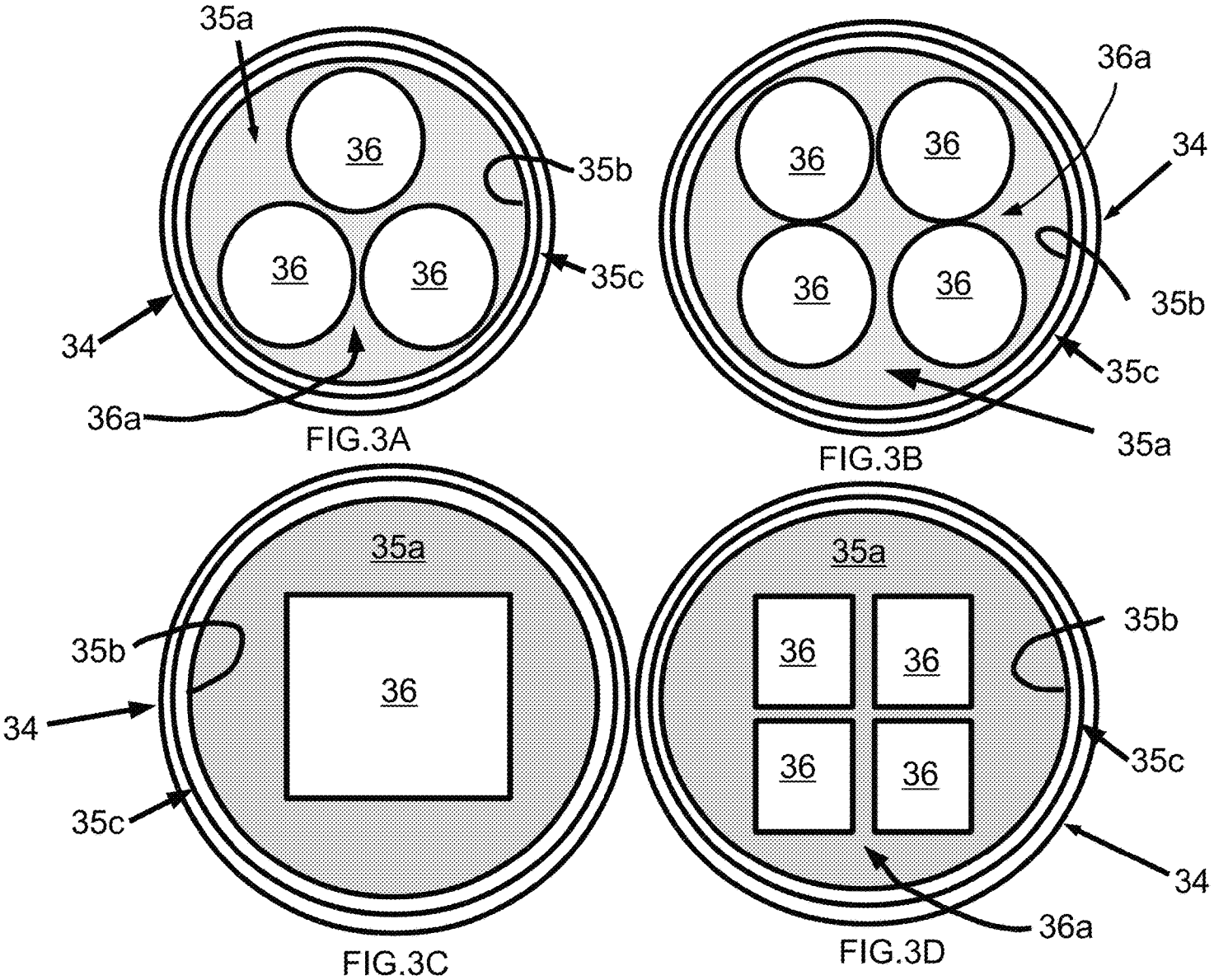
FIG. 3A may show a basic schematic configuration of three nuclear fuel assemblies (nuclear fuel-rod-bundles and/or nuclear control rod fuel assemblies) stacked by circle packing in a capsule carrier tube.
FIG. 3B may show a basic schematic configuration of four nuclear fuel assemblies (fuel-rod-bundles and/or nuclear control rod fuel assemblies) stacked by circle packing in a capsule carrier tube.
FIG. 3C may show a basic schematic configuration of a single nuclear fuel assembly (fuel-rod-bundle and/or nuclear control rod fuel assembly) in a capsule carrier tube.
FIG. 3D may show a basic schematic configuration of four nuclear fuel assemblies (nuclear fuel-rod-bundles, bundle sub-assemblies, and/or nuclear control rod fuel assemblies) stacked by circle packing in a capsule carrier tube.

FIG. 4 may illustrate a cross-section of: a carrier tube 34 (with nuclear fuel assemblies 36 with HLW and/or SNF) within a wellbore 15/20/20*a* of deep-geological-formation 38 (repository rock formation 38). Note, FIG. 4 may be a cross-section through a given waste-capsule 25 (carrier tube 34) shown in FIG. 8. In this cross-sectional view, wellbore-interior-surface 32 of the given wellbore 15/20/20*a* may be shown. As shown in FIG. 4, three different nuclear fuel assemblies 36 may be circle packed in a triangular fashion within carrier tube 34, just as shown in FIG. 3A. It should be appreciated that any of the circle packing examples of nuclear fuel assemblies 36 within a given carrier tube 34 shown in FIG. 3B, FIG. 3C, or FIG. 3D could have been shown implemented in the environment of FIG. 4, without deviating from the scope of the present invention. The number of circle-packed fuel assemblies 36 may vary depending on size and geometry of the disposal wellbores 15/20/20*a* and/or may vary depending on size and geometry of the carrier tubes 34 (waste capsules 25).

Continuing discussing FIG. 4, in some embodiments, disposed within the given carrier tube 34 may be supports 39 (or a support system 39). In some embodiments, waste-capsule 25 may comprise at least one support 39 within carrier tube 34 for supporting (and/or for separating/dividing) a predetermined quantity of radioactive materials in protective-medium 35*a*. In some embodiments, the supports 39 may physically separate (divide) each nuclear fuel assembly 36 from another nuclear fuel assembly 36 within carrier tube 34. In some embodiments, the supports 39 may provide at least some structural support to a given nuclear fuel assembly 36 within carrier tube 34. In some embodiments, substantially or entirely surrounding each nuclear fuel assembly 36 within carrier tube 34 may be protective-medium 35*a*. In some embodiments, protective-medium 35*a* may substantially fill in the given carrier tube 34 around the nuclear fuel assemblies 34 within the given carrier tube 34. In some embodiments, protective-medium 35*a* may be implemented by injecting protective-medium 35*a* into the given carrier tube 34 and around the fuel assemblies 36 therein. In some embodiments, protective-medium 35*a* may be implemented by manufacturing a mold 35*d*. In some embodiments, mold 35*d* may be substantially constructed of protective-medium 35*a*. In some embodiments, mold 35*d* may have one or more void spaces 35*e* (i.e., cavities) for receiving a given nuclear fuel rod assembly 36. See e.g., FIG. 5 and FIG. 6. In some embodiments, an exterior or outer layer of protective-medium 35*a* may be corrosion protective layer 35*b*.

In some embodiments, inside of carrier tube 34 may be corrosion protective layer 35*b*. In some embodiments, on an inside of carrier tube 34 may be corrosion protective layer 35*b*.

Continuing discussing FIG. 4, in some embodiments, an exterior or outer layer of corrosion protective layer 35*b* may be neutron absorbing layer 35*c*. In some embodiments, a given waste-capsule 25 (carrier tube 34) may comprise at least one neutron absorbing layer 35*c*. In some embodiments, the at least one neutron absorbing layer 35*c* may be configured to absorb and/or slow down a minimal predetermined amount of neutrons. In some embodiments, the at least one neutron absorbing layer 35*c* may be disposed between the inside surface of the carrier tube 34 and the at least one corrosion protective layer 35*b*. In some embodiments, inside of carrier tube 34 may be neutron absorbing layer 35*c*. In some embodiments, on an inside of carrier tube 34 may be neutron absorbing layer 35*c*. In some embodiments, neutron absorbing layer 35*c* may be a layer that substantially absorbs and/or substantially stops neutron passage up to a predetermined threshold. Today (2019), there are commercially available several composite matrix materials of reinforced aluminum boron carbide which have the prerequisite physical properties to be effective neutron absorbers even at elevated temperatures. In some embodiments, neutron absorbing layer 35*c* may be substantially constructed from reinforced aluminum boron carbide and/or the like. In some embodiments, the at least one neutron absorbing layer 35*c* may be substantially comprised of reinforced aluminum boron carbide and/or derivatives thereof. Note, in some embodiments, neutron absorbing layer 35*c* may provide personnel safety during (terrestrial) surface operations. However, neutron absorbing layer 35*c* may be unnecessary when the given carrier tube 34 (waste-capsule 25) has been located (placed) within the given wellbore 15/20/20*a* in deep-geological-formation 38.

Continuing discussing FIG. 4, in some embodiments, around carrier tube 34 may be pipe 31*b* (casing 31*b*) and still within deep-geological-formation 38, and within the given wellbore 15/20/20*a*. In some embodiments, pipe 31*b* may be substantially constructed from steel and/or the like. In some embodiments, pipe 31*b* may be substantially: rigid, hollow, elongate, and cylindrical member. In some embodiments, disposed between pipe 31*b* and carrier tube 34 may be a gap. In some embodiments, disposed between pipe 31*b* and carrier tube 34 may be one or more centralizers 37*a*. In some embodiments, disposed between pipe 31*b* and carrier tube 34 may be three or more centralizers 37*a*. In some embodiments, centralizers 37*a* may be located in the gap between carrier tube 34 and pipe 31*b*. In some embodiments, centralizers 37*a* may be used to maintain a concentric relationship between pipe 31*b* and carrier tube 34. In some embodiments, cement 30 may be pumped into the gap between carrier tube 34 and pipe 31*b*.

Continuing discussing FIG. 4, in some embodiments, around pipe 31*b* may be pipe 31*a* (casing 31*a*) and still within deep-geological-formation 38, and within the given wellbore 15/20/20*a*. In some embodiments, pipe 31*a* may be substantially constructed from steel and/or the like. In some embodiments, pipe 31*a* may be substantially: rigid, hollow, elongate, and cylindrical member. In some embodiments, disposed between pipe 31*a* and pipe 31*b* may be a gap (different from the gap between carrier tube 34 and pipe 31*b*). In some embodiments, disposed between pipe 31*a* and pipe 31*b* may be one or more centralizers 37*a*. In some embodiments, disposed between pipe 31*a* and pipe 31*b* may be three or more centralizers 37*a*. In some embodiments, centralizers 37*a* may be located in the gap between pipe 31*a* and pipe 31*b*. In some embodiments, centralizers 37*a* may be used to maintain a concentric relationship between pipe 31*a* and pipe 31*b*. In some embodiments, cement 30 may be pumped into the gap between pipe 31*a* and pipe 31*b*. In some embodiments, pipe 31*a* may be an outer pipe and pipe 31*b* may be an inner pipe.

Continuing discussing FIG. 4, in some embodiments, around pipe 31*a* and still within deep-geological-formation 38 and within the given wellbore 15/20/20*a*, may be wellbore-interior-surface 32. In some embodiments, wellbore-interior-surface 32 may the interior surface of the given wellbore 15/20/20*a*. In some embodiments, between wellbore-interior-surface 32 and pipe 31*a* may be a gap. In some embodiments, disposed in this gap between wellbore-interior-surface 32 and pipe 31*a* may be cement 30.

Continuing discussing FIG. 4, in some embodiments, cement 30 may be located, placed, inserted, and/or pumped into gaps between: wellbore-interior-surface 32 and pipe 31*a*; pipe 31*a* and pipe 31*b*; pipe 31*b* and carrier tube 34; combinations thereof, and/or the like. In some embodiments, the nuclear waste disposal system may have three separate and distinct layers of cement 30. In some embodiments, cement 30 layers used in the nuclear waste disposal system may be substantially annular rings (e.g., as shown in FIG. 4), minus where centralizers 37*a* may be located.

Continuing discussing FIG. 4, in some embodiments, wellbore-interior-surface 32, pipe 31*a*, pipe 31*b*, carrier tube 34, neutron absorbing layer 35*c*, and/or corrosion protective layer 35*b* may have a concentric relationship with respect to each other.

Continuing discussing FIG. 4, in some embodiments, layers of the nuclear waste disposal system, from the outside towards the center may comprise: a portion of deep-geological-formation 38 (ending at wellbore-interior-surface 32); cement 30, pipe 31*a*, cement 30, pipe 31*b*, cement 30, carrier tube 34, neutron absorbing layer 35*c*, corrosion protective layer 35*b*, protective-medium 35*a*, and lastly nuclear fuel assembly 36 (with HLW and/or SNF). In some embodiments, there may only one pipe layer. In some embodiments, there may be one, two, or three layers of cement 30. In some embodiments, neutron absorbing layer 35*c* and/or corrosion protective layer 35*b* may be absent.

In some embodiments, pipe 31*a*, pipe 31*b*, carrier tube 34 (with nuclear fuel assembly 36), cement(s) 30, centralizers 37*a*, combinations thereof, and/or the like may be placed (located) within the given wellbore 15/20/20*a* in deep-geological-formation 38 via use of drilling-rig 10 and via use of various tools and/or devices (e.g., landing system tool 40*c*, lading sub tool 40*a*, and/or pipe-couplings 40) used in oilfield drilling operations.

Continuing discussing FIG. 4, in some embodiments, deep-geological-formation 38 (repository rock matrix 38) may provide a solid medium in which the casings 31*a*/31*b* may be inserted after a massive drilling and wellbore completion effort utilizing drilling-rig 10. The multiple concentric casing layers 31*a*/31*b*, along with annular cement 30 layers have appropriately placed centralizers 37*a* which are a generally accepted components in oilfield drilling operations.

FIG. 5 may illustrate a perspective schematic view of a mold 35*d*. In some embodiments, mold 35*d* may have one or more void spaces 35*e* (i.e., cavities) for receiving a given nuclear fuel rod assembly 36 (see e.g., FIG. 6). In some embodiments, mold 35*d* may be substantially constructed of protective-medium 35*a*. In some embodiments, protective-medium 35*a* may resist, block, partially block, reduce, minimize, mitigate, combinations thereof, and/or the like with respect to gamma radiation. In some embodiments, mold 35*d* may resist, block, partially block, reduce, minimize, mitigate, combinations thereof, and/or the like with respect to gamma radiation. In some embodiments, at least some exterior surface of mold 35*d* may be coated with corrosion protective layer 35*b*. In some embodiments, a given mold 35*d* may be shaped in accordance with any of the circle packing configurations shown in FIG. 3A, FIG. 3B, FIG. 3C, and FIG. 3D. Additionally, other shapes and/or sizes of molds 35*d* are expressly contemplated. In some embodiments, molds 35*d* may be produced by existing manufacturing practices in which the molds 35*d* are mass produced and then made available for receiving the nuclear fuel assemblies 36. In some embodiments, molds 35*d* may be prefabricated.

In some embodiments, mold 35*d* may be substantially constructed from lead. In some embodiments, mold 35*d* may be substantially constructed from a material with lead like properties. In some embodiments, mold 35*d* may be substantially constructed from one or more of: lead, cadmium, aluminum, lithium, cement polymers, derivatives of cement polymers, combinations thereof, and/or the like.

Further, based on the current (2019) price of lead of $2500/MT (in US dollars), for example, the calculation of additional material cost to provide gamma radiation protection with a lead medium is less than $100 per nuclear fuel assembly 36 for a typical Canadian Nuclear Power Company (CANDU) nuclear fuel assembly 36 (fuel assembly bundle). The cost could vary depending on the dimensional size of the nuclear fuel assembly 36 (nuclear fuel assembly bundle), however these cost figures are relatively trivial when compared to cost of operations in a nuclear environment.

FIG. 6 may show a perspective schematic view of the mold 35*d* of FIG. 5, but wherein the nuclear fuel assemblies 36 are in a process of being inserted into a series of void spaces 35*e* (i.e., cavities) within the given mold 35*d*. In some embodiments, a given mold 35*d* may have at least one void space 35*e*. In some embodiments, a given mold 35*d* may have a plurality of void spaces 35*e*. In some embodiments, each void space 35*e* of a given mold 35*d* may be sized and shaped to receive at least one nuclear fuel assembly 36. In some embodiments, mold 35*d* may be inserted into carrier tube 34 to form a given waste-capsule 25. In some embodiments, mold 35*d* may be inserted into carrier tube 34 and then nuclear fuel assemblies 36 may be inserted into the void spaces 35*e*. In some embodiments, nuclear fuel assemblies 36 may be inserted into the void spaces 35*e* and then mold 35*d* may be inserted into carrier tube 34.

As noted, in some embodiments, protective-medium 35*a* may be in the form of a given mold 35*d* with one or more void spaces 35*e*, wherein each one or more void spaces 35*e* may be configured to receive at least some of a predetermined quantity of radioactive materials (such as, but not limited to, HLW, SNF, nuclear fuel rod assembly 36, combinations thereof, and/or the like). In some embodiments, an exterior of the mold 35*d* may be configured to fit within carrier tube 34 (waste-capsule 25). In some embodiments, mold 35*d* may be configured to shield from gamma radiation. In some embodiments, mold 35*d* may be configured to shield an external environment from gamma radiation originating from the predetermined quantity of radioactive materials within mold 35*d*. In some embodiments, the at least one corrosion protective layer 35*b* may be located on the exterior of the mold 35*d*. In some embodiments, mold 35*d* may be prefabricated. In some embodiments, mold 35*d* may be constructed from a molding operation, a casting operation, a stamping operation, an extrusion operation, a milling operation, a cutting operation, combinations thereof, and/or the like. In some embodiments, mold 35*d* may be substantially comprised of one or more of: lead, lead alloy, cadmium, cadmium alloy, lithium, lithium alloy, cement polymers, combinations thereof, and/or the like.

Whereas in contrast to mold 35*d*, in some embodiments, protective-medium 35*a* may be injected into carrier tube 34 in an initially flowable form and that substantially surrounds the predetermined quantity of radioactive materials within carrier tube 34.

In some embodiments, prior to injecting the initially flowable protective-medium 35*a* into the given carrier tube 34, an inside of the given carrier-tube 34 may be coated with a release agent such that after the protective-medium 35*a* has been injected into that carrier-tube 34 and has at least partially solidified (so can be handled as one unit), the now at least partially solidified protective-medium 35*a*, with the predetermined quantity of radioactive materials, may be removable from that carrier tube 34. Such removing, may then permit application of at least one corrosion protective layer 35*b* to the protective-medium 35*a*. In some embodiments, when the at least partially solidified protective-medium 35*a*, with the predetermined quantity of radioactive materials, may be removed from that carrier tube 34, then the at least one corrosion protective layer 35*b* may be applied to an exterior of protective-medium 35*a*. Then protective-medium 35*a*, with the predetermined quantity of radioactive materials, and now with the at least one corrosion protective layer 35*b*, may be inserted into that carrier tube 34. In some embodiments, applying the at least one corrosion protective layer 35*b* to an exterior of protective-medium 35*a*, may involve one or more of: spraying, coating, dipping, painting, wrapping, combinations thereof, and/or the like, the at least one corrosion protective layer 35*b* onto the exterior of protective-medium 35*a*.

FIG. 7 may show a perspective and partial cutaway view of a commercial capsule carrier, contemplated by various embodiments of the present invention, designated herein as "transporter 45" for transporting completed nuclear waste-capsules 25 (with HLW and/or SNF) during (terrestrial) transport operations, such as from nuclear power plant 10*a* to drilling-rig 10; and/or from surface-storage-location 10*b* to drilling-rig 10. In some embodiments, surface transport of a given transporter 45 could be transported via rail and/or truck. In some embodiments, a given transporter 45 may be designed for and/or configured for: protecting its cargo (e.g., the completed waste-capsules 25) from shock (e.g., kinetic impacts); protecting the public from radiation exposure; protecting the environment from radiation exposure; maintaining the integrity of the waste-capsule(s) 25 stored within the given transporter 45; combinations thereof; and/or the like.

Continuing discussing FIG. 7, in some embodiments, a given transporter 45 may be a substantially rigid to a rigid elongate member configured for housing one or more waste-capsule(s) 25 (carrier tube(s) 34). In some embodiments, a given transporter 45 may be a substantially cylindrical member configured for housing one or more waste-capsule(s) 25 (carrier tube(s) 34). In some embodiments, an exterior of transporter 45 may be outer shell 45*d*. In some embodiments, outer shell 45*d* may have a substantially cylindrical and/or elongate shape. In some embodiments, outer shell 45*d* may provide structural support of transporter 45. In some embodiments, outer shell 45*d* may be substantially constructed from one or more materials of: steel, carbon steel, stainless steel, steel alloys, combinations thereof, and/or the like.

Continuing discussing FIG. 7, in some embodiments, a given transporter 45 may carry, house, and/or temporarily store the waste-capsule(s) 25 (carrier tube(s) 34). In some embodiments, one or more waste-capsule(s) 25 (carrier tube(s) 34) may be stacked internally inside a given transporter 45. In some embodiments, a given transporter 45 may comprise at least one basket 45*b*. In some embodiments, at least one basket 45*b* may be located within the given transporter 45. In some embodiments, a given basket 45*b* may hold one or more waste-capsule(s) 25 (carrier tube(s) 34). In some embodiments, a given basket 45*b* may be configured for removably receiving one or more waste-capsule(s) 25 (carrier tube(s) 34). In some embodiments, the one or more waste-capsule(s) 25 (carrier tube(s) 34) may be fixedly held together inside the given transporter 45 with at least one basket 45*b*.

Continuing discussing FIG. 7, in some embodiments, a given transporter 45 may comprise one or more heat conductors 45*c*. In some embodiments, the one or more heat conductors 45*c* may be configured to transport heat from the one or more waste-capsule(s) 25 (carrier tube(s) 34) and out of the given transporter 45. In some embodiments, heat conductors 45*c* may be utilized to dissipate the heat generated during transit by the decay of the HLW and/or SNF nuclear waste material contained inside the one or more waste-capsule(s) 25 (carrier tube(s) 34). In some embodiments, heat conductors 45*c* may prevent any overheating of the transporter 45. In some embodiments, the one or more heat conductors 45*c* may be one or more heat conductive fins. In some embodiments, the one or more heat conductors 45*c* may be located on, in, and/or outside of outer shell 45*d* of the given transporter 45. In some embodiments, the one or more heat conductors 45*c* may be located radially around a circumference (periphery) of the transporter 45, with respect to an axial center of the transporter 45. In some embodiments, the one or more heat conductors 45*c* may be located at at least one end of the transporter 45. In some embodiments, the one or more heat conductors 45*c* may be located below basket 45*b* in transporter 45. In some embodiments, the one or more heat conductors 45*c* may be located below the one or more waste-capsules 25 (carrier tubes 34) in transporter 45.

Continuing discussing FIG. 7, in some embodiments, disposed inside of an outer shell 45*d* of a given transporter 45 may be one or more neutron shielding elements 45*e*. In some embodiments, the one or more neutron shielding elements 45*e* may be located exterior to basket 45*b*. In some embodiments, the one or more neutron shielding elements 45*e* may provide for radiation protection by providing for a means to absorb neutrons and/or slow down neutrons. Effective neutron shielding elements 45*e* may be made from a variety of polymer-based materials composed of an effective neutron moderator, such as, but not limited to, hydrogen and carbon, and/or the like; and/or a neutron poison, such as, but not limited to, boron and/or the like. In some embodiments, a given neutron shielding elements 45*e* may be a cylindrical sheath; and may surround the inner basket 45*b* carrying the nuclear/radioactive material (inside of waste-capsules 25 [carrier tubes 34]).

Continuing discussing FIG. 7, in some embodiments, disposed inside of an outer shell 45*d* of a given transporter 45 may be one or more gamma shielding elements 45*f*. In some embodiments, the one or more gamma shielding elements 45*f* may be located exterior to basket 45*b*. In some embodiments, the one or more gamma shielding elements 45*f* may provide for radiation protection by providing for a means for absorbing gamma emissions. Gamma radiation shielding can be achieved by using materials of high density and/or of relatively high atomic numbers. For example, materials like lead and/or tungsten may be used for gamma radiation shielding. In some instances, metal foams made from steel or aluminum may be used to provide adequate radiation shielding. In some instances, depleted uranium may be used for gamma ray shielding. In some embodiments, gamma shielding elements 45*f* may be cylindrical sheaths and may surround the inner basket 45*b* carrying the nuclear/radioactive material (inside of waste-capsules 25 [carrier tubes 34]).

Continuing discussing FIG. 7, in some embodiments, a given transporter 45 may comprise at least one end plug 45*g*. In some embodiments, the at least one end plug 45*g* may be located on a terminal end of transporter 45. In some embodiments, the at least one end plug 45*g* may be attached to a terminal end of transporter 45. In some embodiments, the at least one end plug 45*g* may be removably attached to a terminal end of transporter 45. In some embodiments, each terminal end of the given transporter 45 have an end plug 45*g*. In some embodiments, a given end plug 45*g* may provide shock absorption (kinetic energy absorption, e.g., from impacts/collisions). In some embodiments, a given end plug 45*g* (attached to a given transporter 45) may be provide enhanced/increased shock absorption to the given transporter 45. In some embodiments, a coupling 45*a* disposed between end plug 45*g* and a terminal end of transporter 45 may be used to attach (couple) that end plug 45*g* to that terminal end. In some embodiments, coupling 45*a* may be inserted into an inside of a terminal end of a given transporter 45.

Continuing discussing FIG. 7, in some embodiments, a given transporter 45 may comprise one or more handling attachments 45*h*. In some embodiments, disposed on an exterior of outer shell 45*d* may be the one or more handling attachments 45*h* protruding away from outer shell 45*d*. In some embodiments, a given handling attachment 45*h* may provide a means by which the given transporter may be lifted and/or handled. In some embodiments, a given handling attachment 45*h* may be an anchor point for various handling/lifting equipment.

FIG. 8 may illustrate a series of waste capsules 25 (carrier tubes 34) with HLW and/or SNF nuclear waste material that are connected sequentially in a linear end-to-end fashion to form an integral unit called herein, a "chorizo." In this patent application the inventor defines a "chorizo," (cho-ree-so, Spanish word for a sausage link) as an integral chain of waste-capsules 25 (carrier tubes 34) connected sequentially in a linear end-to-end fashion like a series of link sausages along with any spacers (e.g., pipe-couplings 40) and other handling type apparatuses (e.g., landing tools 40*c* and/or landing sub tools 40*a*) needed to place (locate) and/or withdraw a given chorizo from a given wellbore 15/20/20*a* within deep-geological-formation 38. In some embodiments, a given chorizo may be "landed" or inserted into the given wellbore 15/20/20*a* drilled in the formation rock in/of deep-geological-formation 38. Such a chorizo may allow several (a plurality of) waste-capsules 25 (carrier tubes 34) and their spacers and couplings 40 to form this longer cylindrical unit which may then be implemented in drilling operations as an integral string which is typical of the oilfield industry field practices and processes. This familiarity and commonality of widespread use of oilfield industry field practices and processes may allow the subject invention implemented herein to be utilized extremely economically today without the need to devise and/or re-invent a whole new set of operational practices and processes.

Continuing discussing FIG. 8, in some embodiments, at a proximal end of the chorizo (e.g., the end of the chorizo closest to drilling-rig 10) may be a landing tool 40*c* which may allow an operator (generally located on the terrestrial surface and operating drilling-rig 10) to insert and place ("land") the chorizo into the wellbore 15/20/20*a* at a particular desired location in the wellbore 15/20/20*a* and in the deep-geological-formation 38.

Continuing discussing FIG. 8, in some embodiments, at a proximal end of the chorizo may be a detachable tool 40*b*. In some embodiments, detachable tool 40*b* may be used to retrieve a given previously landed chorizo. In some embodiments, detachable tool 40*b* may be an oilfield industry standard "fishing tool." In some embodiments, detachable tool 40*b* may be used to pull back the given chorizo to the terrestrial surface (e.g., at drilling-rig 10) from the given wellbore 15/20/20*a* after that given chorizo had previously been landed in the given wellbore 15/20/20*a*.

Continuing discussing FIG. 8, in some embodiments, at a distal end of the chorizo (e.g., disposed opposite from the proximal end and/or the end of the chorizo farthest to drilling-rig 10) may be landing sub tool 40*a*. In some embodiments, landing sub tool 40*a* may help to guide a given chorizo within the given wellbore 15/20/20*a*. In some embodiments, landing sub tool 40*a* may provide for easier insertion/landing of the given chorizo within the given wellbore 15/20/20*a*. In some embodiments, landing sub tool 40*a* may be substantially an oilfield device generally called a "sub" which allows for and guides within a wellbore.

Continuing discussing FIG. 8, in some embodiments, a given chorizo may also comprise at least one spacer 44 located between two otherwise adjacent waste-capsules 25 (carrier tubes 34). In some embodiments, a spacer 44 may be attached to a different terminal end of each of two adjacent waste-capsules 25 (carrier tubes 34). In some embodiments, a given spacer 44 may not initially comprise any: nuclear material, fuel rod assembly 36 (or portions thereof), HLW, SNF, radioactive materials, combinations thereof, and/or the like. (However, over long time periods (e.g., geologic time), spacer 44 could become at least partially radioactive.) In some embodiments, spacers 44 may be used to help manage the overall heat and/or temperature of a given chorizo. The more spacers 44 a given chorizo may have, the more likely that heat will be more dispersed for that chorizo.

Note, FIG. 4 may be a cross-section through a given waste-capsule 25 (carrier tube 34) shown in FIG. 8.

FIG. 9 may depict a flowchart of various methods, processes, and/or steps employed by various embodiments of the present invention. The FIG. 9 flowchart may be summarized in four integrated groups of tasks. These task groups are as follows:

- Task Group A: Preparing the intact nuclear fuel rod assemblies 36 for eventual insertion into a given waste-capsule 25 (carrier tube 34), illustrated by steps: 806, 807, 808, 809, and 810;
- Task Group B: Prepare a given waste-capsule 25 (carrier tube 34) for receiving a bundle 36*a*, illustrated by steps: 811, 812, 813, 814, 815, 816, and 817;
- Task Group C: Implementing the capsule string (chorizo) and "landing" the completed nuclear waste capsules (chorizo) in the subject wellbores, illustrated in steps 818, 819, 820, 821, 822, and 835;
- Task Group D: Design and drill the wellbores, illustrated in steps 823, 825, 827, 829, 831, and 833.

The term "landing" is an oilfield industry term which describes the operation of installing a device or system inside a wellbore system using surface equipment (such as drilling-rig 10).

In some embodiments, Task Group A, Task Group B, Task Group C, and Task Group D of FIG. 9, together may present steps of a method for the long-term storage (disposal) of high-level nuclear waste (e.g., HLW and/or SNF) in waste-capsules 25 (carrier tubes 34) in wellbores 15/20/20*a* in a specific deep-geological-formation 38. In some embodiments, Task Group A, Task Group B, Task Group C, and/or Task Group D of FIG. 9, may present steps of a method for handling nuclear waste. In some embodiments, the method of FIG. 9 may be a method for processing nuclear fuel assemblies 36 for subterranean storage in deep-geological-formations 38, according to one or more embodiments of the present invention. In some embodiments, the method of FIG. 9 may be a method for subterranean storage of nuclear waste in deep-geological-formations 38.

Continuing discussing FIG. 9, in some embodiments, Task Group A may comprise steps 806 through 810. In some embodiments, the steps of Task Group A may (or may not) occur away from the subterranean storage location site; i.e., away from below where deep-geological-formation 38 may be located. In some embodiments steps 807 through step 810 may occur at or remote from the subterranean storage location site. See e.g., FIG. 9.

Continuing discussing FIG. 9, in some embodiments, nuclear fuel rod assemblies 36 may be stored at a surface-storage-location 10*b* (see e.g., FIG. 1), such as in storage pools. For example, nuclear waste from the nuclear power plant(s) 10*a* may be stored at step 806 for cooling for periods of several years, such as, between four and 30 years, or for up to 30 years or more in other embodiments. Such surface storage may be initially done in cooling pools; sometimes then later in casks or other massive protected containers on or near the (terrestrial) surface. In some embodiments, step 806 may progress into step 807.

Continuing discussing FIG. 9, in some embodiments, step 807 may be step of receiving the nuclear fuel rod assemblies 36 from that surface storage (e.g., from cooling pools or casks). That is, in some embodiments, the receiving step 807 may be a harvesting step, as in a step of harvesting the nuclear fuel rod assemblies 36 from the surface storage. In some embodiments, step 807 may transition into step 808.

Continuing discussing FIG. 9, in some embodiments, step 808 may be step of maintaining the nuclear fuel rod assemblies 36 in an intact form. In some embodiments, step 808 may progress into step 809. Step 808 may be optional in some embodiments, in which case, step 807 may progress directly to step 809 or to step 810.

Continuing discussing FIG. 9, in some embodiments, in step 809 the previously received nuclear fuel rod assemblies 36 may be circle-packed in a preparatory manner so that they can fit easily into a given waste-capsule (carrier tube 34). Once a group of nuclear fuel rod assemblies 36 are circle-packed together, that group of now circle-packed and bundled nuclear fuel rod assemblies 36 may be designated a "bundle 36*a*." Circle-packing could proceed according to the teachings of FIG. 3 and/or via circle-packing standards common in industry. In some embodiments, step 809 may progress into step 810.

Continuing discussing FIG. 9, in some embodiments, step 810 may be a step where a given bundle 36*a* is now ready for being encapsulated within a given waste-capsule 25 (carrier tube 34). In some embodiments, step 810 may progress into step 811 (of Task Group B). In some embodiments, completion of Task Group A may then feed into Task Group B.

In some embodiments, step 807, step 808, step 809, and/or step 810 may be at least substantially automated and performed by robotics or the like, to increase safety to personnel. Such automation may be shielded (radiation shielding) and/or utilize various containment protocols in some embodiments.

Continuing discussing FIG. 9, in some embodiments, Task Group B may comprise steps 811 through 817 (with some such steps being optional in some embodiments, e.g., depending upon outcome of decision 812). In some embodiments, step 811 may be a step of installing the neutron absorbing layer 35*c* inside the carrier tube 34. In some embodiments, step 811 may then progress to decision 812.

Continuing discussing FIG. 9, in some embodiments, decision 812 may a step of deciding which type of protective-medium 35*a* to used inside of the given carrier-tube 34, that of an injectable protective-medium 35*a* (i.e., a flowable protective-medium 35*a*) or that of a cast/molded mold 35*d* (e.g., shown in FIG. 5 and FIG. 6) (i.e., a solid [or solid-like] protective-medium 35*a*). Use of a flowable protective-medium 35*a* may proceed along step 814 and step 816. Whereas, use of mold 35*d* of protective-medium 35*a* may proceed along step 813 and step 815. In some embodiments, decision 812 may be made based on the equipment and/or personnel available, coupled with the comparative economics of operations between the mold 35*d* preparation processes or the initially flowable protective-medium 35*a* injection processes.

Continuing discussing FIG. 9, in some embodiments, step 813 may be a step of molding/casting to generate at least one mold 35*d* of protective-medium 35*a*. In some embodiments, mold 35*d* may have one or more void spaces 35*e* for receiving bundles 36*a* (and/or for receiving nuclear fuel rod assemblies 36). In some embodiments, step 813 may progress into step 815.

Continuing discussing FIG. 9, in some embodiments, step 815 may be a step of receiving the bundles 36*a* (and/or the nuclear fuel rod assemblies 36) into the one or more void spaces 35*e* of mold 35*d*. See e.g., FIG. 5 and FIG. 6. In some embodiments, step 815 may progress into step 817.

Continuing discussing FIG. 9, in some embodiments, step 817 may be a step of incorporating at least one passivity element (e.g., corrosion protection/resistance element) to an exterior of the protective-medium 35*a*. In some embodiments, step 817 may be a step of adding corrosion protection layer 35*b* to an exterior of protective-medium 35*a*. In some embodiments, step 817 may be a step of adding corrosion protection layer 35*b* to an inside of the neutron absorbing layer 35*c*. In some embodiments, step 817 may progress into step 818.

Continuing discussing FIG. 9, in some embodiments, step 814 may be a step of implementing a flowable protective-medium 35*a* into the given carrier tube 34 and around the bundles 36*a* (and/or the nuclear fuel rod assemblies 36) that are inside of the given carrier tube 34. In some embodiments, in step 814, the protective-medium 35*a* may be injected in a fluid or semi-liquid state into the void surrounding the waste bundles 36 in the given carrier tube 34 (e.g., resulting in a scenario shown in FIG. 4). In some embodiments, step 814 may include coating an interior surface of carrier tube 34 (or an interior surface of the neutron absorbing layer 35*c*) with a release agent, such that the flowable protective-medium 35*a* (with the bundles 36*a*/36), once at least somewhat cured/solidified, may be removed from the given carrier tube 34. In some embodiments, step 814 may progress into step 816.

Continuing discussing FIG. 9, in some embodiments, step 816 may be a step of removing the at least somewhat cured/solidified protective-medium 35*a* (with the bundles 36*a*/36) from the given carrier tube 34. This may be necessary in preparation for step 817. This may be necessary and/or desired to allow some cooling of protective-medium 35 and/or cooling of carrier tube 34. In some embodiments, step 816 may then progress into step 817 (step 817 was discussed above).

Continuing discussing FIG. 9, in some embodiments, Task Group C may comprise steps 818 through 835 (with some such steps being optional in some embodiments). In some embodiments, step 818 may be a step of inserting the protective-medium 35*a* (with the bundles 36*a*/36) (and which may be in mold 35*d* form) into the given carrier tube 34. Note when step 817 follows step 816, after incorporating the corrosion protection layer 35*b*, then step 818 may be a step of re-installing the protective-medium 35*a* (now with the corrosion protection layer 35*b* and still with the bundles 36*a*/36) back into its carrier tube 34. In some embodiments, step 818 may also be a step of sealing that given carrier tube 34 (with the protective-medium 35*a* and with the bundles 36*a*/36). In some embodiments, step 818 may be repeated to generate a predetermined quantity of sealed carrier tubes 34 (each with its own the protective-medium 35*a* and with its own bundles 36*a*/36). In some embodiments, step 818 may progress into step 819.

Continuing discussing FIG. 9, in some embodiments, step 819 may be a step of using/installing at least one spacer 44 at a terminal end of a given carrier tube 34. In some embodiments, step 819 may be a step of using/installing at least one spacer 44 between two sealed carrier tubes 34. See e.g., FIG. 8. In some embodiments, step 819 may be repeated for more than one sealed carrier tube 34. In some embodiments, step 819 may progress into step 820.

Continuing discussing FIG. 9, in some embodiments, step 820 may be a step of forming at least one chorizo. In some embodiments, step 820 may be a step of linking the sealed carrier tubes 34 of step 818 end to end to form the at least one chorizo. In some embodiments, step 820 may be a step of using/installing at least one pipe coupling 40 between two sealed carrier tubes 34. See e.g., FIG. 8. In some embodiments, step 820 may be repeated to form more than one chorizo. In some embodiments, step 820 may progress into step 821.

Continuing discussing FIG. 9, in some embodiments, step 821 may be a step of inserting a given chorizo into a given borehole 15/20/20*a*. In some embodiments, boreholes 20/20*a* may be located in deep-geological-formation 38. In some embodiments, at least a portion of a given borehole 15 (e.g., a distal portion) may be located in deep-geological-formation 38 (whereas proximal portions of borehole 15 may be located at or near the terrestrial surface, e.g., near drilling-rig 10). In some embodiments, step 821 may be a step of inserting a given chorizo into inner pipes 31*b* of a given borehole 15/20/20*a*. In some embodiments, wherein insertion of more than one chorizo into a system of boreholes 15/20/20*a* (or into the same borehole 15/20/20*a*) may be contemplated, then step 821 may progress back to step 820 to form another chorizo for insertion. In some embodiments, step 821 may progress to step 822.

Continuing discussing FIG. 9, in some embodiments, step 822 may be a step of completing sequential insertion of all formed chorizos into the given borehole 15/20/20*a* (or system of boreholes 15/20/20*a*). In some embodiments, step 822 may be a step of completing sequential insertion of all formed chorizos into pipes 31*a*/31*b* of the given borehole(s) 15/20/20*a*. In some embodiments, step 822 may progress into step 835.

Continuing discussing FIG. 9, in some embodiments, step 835 may be a step of sealing the borehole(s) 15/20/20*a* that had received at least one chorizo (or had received at least one sealed carrier tube 34). In some embodiments, this sealing step may utilize one or more fillers, such as, but not limited to, cement(s), bentonite(s), mechanical packer(s), combinations thereof, and/or the like. In some embodiments, this sealing step may be a step of back filling the borehole(s) 15/20/20*a* that had received at least one chorizo (or had received at least one sealed carrier tube 34).

In some embodiments, completion of step 835 may complete execution of Task Group C. In some embodiments, completion of step 835 may complete execution of the method for the long-term storage (disposal) of high-level nuclear waste (e.g., HLW and/or SNF) in waste-capsules 25 (carrier tubes 34) in wellbores 15/20/20*a* in deep-geological-formation 38.

Continuing discussing FIG. 9, in some embodiments, Task Group D may comprise steps 823 through 833 (with some such steps being optional in some embodiments). In some embodiments, Task Group D may involve the steps for forming the boreholes 15/20/20*a* and preparing those formed boreholes 15/20/20*a* for receiving at least one chorizo (or for receiving at least one sealed carrier tube 34). In some embodiments, Task Group D may be implemented at suitable selected locations remote from the nuclear power plant(s) 10*a* and/or from surface-storage-location(s) 10*b* (e.g., terrestrial surface cooling pools/vats). In some embodiments, completion of Task Group D may be necessary for completion of Task Group C. In some embodiments, Task Group D may feed into Task Group C. In some embodiments, Task Group D may occur independently (before or after) of Task Group A and/or Task Group B.

Continuing discussing FIG. 9, in some embodiments, step 823 may be a step of determining appropriate metrics for the wellbore system to be implemented from terrestrial surface location of drilling-rig 10 to location(s) within a given deep-geological-formation 38 (e.g., host rock). In some embodiments, step 823 may be a step of determining at least some optimal metrics for the wellbore system to be implemented from terrestrial surface location of drilling-rig 10 to location(s) within a given deep-geological-formation 38 (e.g., host rock). Some of these metrics may comprise one or more of: optimal design data, diameters, azimuth, depths, slopes, sizes/sizing, runs/lengths, pipe 31*a*/31*b* selection, cement(s) 30 selection, combinations thereof, and/or the like—all with respect to the intended wellbore system. In some embodiments, various computer simulations and related tools may be used in implementing step 823. In some embodiments, step 823 may progress into step 825.

Continuing discussing FIG. 9, in some embodiments, step 825 may be a step of forming wellbores 15/20/20*a*. In some embodiments, step 825 may involve first drilling vertical wellbore 15 using drilling-rig 10 starting at a terrestrial surface location and working substantially vertically downwards into the intended deep-geological-formation 38. In some embodiments, once an appropriate depth of the vertical wellbore 15 may be reached into deep-geological-formation 38, then lateral wellbores 20/20*a* may be drilled out in deep-geological-formation 38. See also FIG. 1. In some embodiments, step 825 may progress into step 827.

Continuing discussing FIG. 9, in some embodiments, step 827 may be a step of installing outer pipes (casings) 31*a* and its centralizers 37*a* into the wellbores 15/20/20*a* formed in step 825. In some embodiments, step 827 may entail installing centralizers 37*a* on an inside of outer pipes (casings) 31*a*; and then installing those outer pipes 31*a* into the wellbores 15/20/20*a*. See also FIG. 4. In some embodiments, step 827 may progress into step 829.

Continuing discussing FIG. 9, in some embodiments, step 829 may be a step of injecting cement 30 into the annulus between outer pipes 31*a* and wellbore-interior-surface 32 of deep-geological-formation 38. See also FIG. 4. In some embodiments, step 829 may progress into step 831.

Continuing discussing FIG. 9, in some embodiments, step 831 may be a step of installing inner pipes (casings) 31*b* and its centralizers 37*a* into the outer pipes 31*a*. In some embodiments, step 831 may entail installing centralizers 37*a* on an inside of inner pipes (casings) 31*b*; and then installing those inner pipes 31*b* into the outer pipes 31*a*. See also FIG. 4. In some embodiments, step 831 may progress into step 833.

Continuing discussing FIG. 9, in some embodiments, step 833 may be a step of injecting cement 30 into the annulus between inner pipes 31*b* and the outer pipes 31*a*. See also FIG. 4. In some embodiments, step 833 (of Task Group D) may progress into step 821 (of Task Group C).

In some embodiments, in step 827, step 829, step 831, and step 833, processes are implemented to "complete" the wellbore system by installing the outer pipes (casings) 31*a*, centralizers 37*a*, inner pipes (casings) 31*b*, and cement 30 annular layers.

At the end of task Group D steps, the physical wellbore system may be complete geologic repository implemented in a given/specific deep-geological-formation 38, ready and available for insertion of at least one chorizo (e.g., string of sealed waste-capsules 25 [carrier tubes 34]) or for insertion of at least one sealed carrier tube 34.

Per the above a waste-capsule 25 configured for long-term storage of a predetermined quantity of radioactive materials (such as, but not limited to, HLW and/or SNF). In some embodiments, a given waste-capsule 25 may comprise a carrier tube 34. In some embodiments, carrier tube 34 may be an exterior of waste-capsule 25. In some embodiments, carrier tube 34 may house the predetermined quantity of radioactive materials. In some embodiments, the given waste-capsule 25 may comprise a protective-medium 35*a*. In some embodiments, protective-medium 35*a* may be disposed within carrier tube 34. In some embodiments, protective-medium 35*a* may substantially surround the predetermined quantity of radioactive materials that may be within carrier tube 34. In some embodiments, protective-medium 35*a* may be configured to minimize degradation to carrier tube 34. In some embodiments, protective-medium 35*a* may be configured to isolate the predetermined quantity of radioactive materials from an external environment. In some embodiments, this external environment may be at least a portion of deep-geological-formation 38 that surrounds a given waste-capsule 25. In some embodiments, this external environment may be regions proximate (next to, adjacent to) waste-capsule 25, but external to waste-capsule 25. In some embodiments, the given waste-capsule 25 may comprise at least one corrosion protective layer 35*b*. In some embodiments, the at least one corrosion protective layer 35*b* may be disposed between protective-medium 35*a* and an inside surface of carrier tube 34. In some embodiments, the at least one corrosion protective layer 35*b* may be configured to minimize electron exchange between metals and oxidants. In some embodiments, the at least one corrosion protective layer 35*b* may protect protective-medium 35*a* from corrosion related degradation.

In some embodiments, the given waste-capsule 25 may be inserted into a given wellbore 15/20/20*a*. In some embodiments, the given wellbore 15/20/20*a* may be drilled into and located within deep-geological-formation 38.

In some embodiments, the predetermined quantity of radioactive materials may be selected from one or more of: HLW, SNF, at least one nuclear fuel rod assembly 36, at least one fully intact nuclear fuel rod assembly 36, at least a portion of one nuclear fuel rod assembly 36, a plurality of nuclear fuel rod assemblies 36, a plurality of fully intact nuclear fuel rod assemblies 36, combinations thereof, and/or the like.

In some embodiments, the predetermined quantity of radioactive materials may be at least one intact nuclear fuel rod assembly 36, wherein carrier tube 34 may house the at least one intact nuclear fuel rod assembly 36 within protective-medium 35*a*. In some embodiments, the predetermined quantity of radioactive materials may be a plurality of intact nuclear fuel rod assemblies 36, wherein carrier tube 34 may house the plurality of intact nuclear fuel rod assemblies 36 within protective-medium 35*a*. In some embodiments, the plurality of intact nuclear fuel rod assemblies 36 may be housed in carrier tube 34 (waste-capsule 25) in a circle packing configuration, with respect to a cross-section through a diameter of carrier tube 34 (waste-capsule 25). In some embodiments, waste-capsule 25 may comprise at least one support 39 for supporting (and/or for dividing/separating) the plurality of intact nuclear fuel rod assemblies 36 in the circle packing configuration. In some embodiments, the plurality of intact nuclear fuel rod assemblies 36 may be housed in carrier tube 34 (waste-capsule 25) in a rectilinear packing configuration, with respect to a cross-section through a diameter of carrier tube 34 (waste-capsule 25). In some embodiments, waste-capsule 25 may comprise at least one support 39 for supporting (and/or for dividing/separating) the plurality of intact nuclear fuel rod assemblies 36 in the rectilinear packing configuration.

Systems and method for the long-term storage (disposal) of high-level nuclear waste (e.g., HLW and/or SNF) in waste-capsules (carrier tubes) in wellbores in deep-geological-formation, including a transporter for terrestrial transportation, have been described. The foregoing description of the various embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical, it is to be understood that the invention is not to be limited to the disclosed embodiments, but on the contrary, is intended to cover various modifications and equivalent arrangements included within the spirit and scope of the appended claims.

What is claimed is:

1. A waste-capsule configured for long-term storage of a predetermined quantity of radioactive materials, wherein the waste-capsule comprises:

a carrier tube that is an exterior of the waste-capsule, wherein the carrier tube houses the predetermined quantity of radioactive materials;

a protective-medium disposed within the carrier tube, wherein the protective-medium substantially surrounds the predetermined quantity of radioactive materials that are within the carrier tube, wherein the protective-medium is configured to minimize degradation to the carrier tube, wherein the protective-medium is configured to isolate the predetermined quantity of radioactive materials from an external environment; and at least one corrosion protective layer disposed between the protective-medium and an inside surface of the carrier tube, wherein the at least one corrosion protective layer is configured to minimize electron exchange between metals and oxidants to protect the protective-medium from corrosion degradation.

2. The waste-capsule according to claim 1, wherein the waste-capsule further comprises at least one neutron absorbing layer, wherein the at least one neutron absorbing layer is configured to absorb and slow down a minimal predetermined amount of neutrons.

3. The waste-capsule according to claim 2, wherein the at least one neutron absorbing layer is disposed between the inside surface of the carrier tube and the at least one corrosion protective layer.

4. The waste-capsule according to claim 2, wherein the at least one neutron absorbing layer is substantially comprised of reinforced aluminum boron carbide or derivatives thereof.

5. The waste-capsule according to claim 1, wherein the protective-medium is a mold with one or more void spaces, wherein each one or more void spaces is configured to receive at least some of the predetermined quantity of radioactive materials, wherein an exterior of the mold is configured to fit within the carrier tube.

6. The waste-capsule according to claim 5, wherein the mold is configured to shield from gamma radiation.

7. The waste-capsule according to claim 5, wherein the at least one corrosion protective layer is located on the exterior of the mold.

8. The waste-capsule according to claim 5, wherein the mold is prefabricated.

9. The waste-capsule according to claim 5, wherein the mold is substantially comprised of one or more of: lead, lead alloy, cadmium, cadmium alloy, lithium, lithium alloy, or cement polymers.

10. The waste-capsule according to claim 1, wherein the protective-medium is injected into the carrier tube in an initially flowable form and that substantially surrounds the predetermined quantity of radioactive materials within the carrier tube.

11. The waste-capsule according to claim 10, wherein prior to injecting the protective-medium into the carrier tube, the inside of the carrier-tube is coated with a release agent such that after the protective-medium has been injected into the carrier-tube and has at least partially solidified, the now at least partially solidified protective-medium, with the predetermined quantity of radioactive materials, is removable from the carrier tube.

12. The waste-capsule according to claim 11, wherein the at least partially solidified protective-medium, with the predetermined quantity of radioactive materials, is removed from the carrier tube and the at least one corrosion protective layer is applied to an exterior of the protective-medium, and then the protective-medium, with the predetermined quantity of radioactive materials, is inserted into the carrier tube.

13. The waste-capsule according to claim 1, wherein the carrier tube is substantially constructed from at least one type of metal or metal alloy.

14. The waste-capsule according to claim 1, wherein the carrier tube is substantially constructed from at least one type of steel.

15. The waste-capsule according to claim 1, wherein the carrier tube is an elongate cylindrical member.

16. The waste-capsule according to claim 15, wherein the elongate cylindrical member has two opposing terminal ends that are sealable, such that a volume within the carrier tube is completely sealed off from the external environment.

17. The waste-capsule according to claim 1, wherein the predetermined quantity of radioactive materials are at least one intact nuclear fuel rod assembly, wherein the carrier tube houses the at least one intact nuclear fuel rod assembly within the protective-medium.

18. The waste-capsule according to claim 1, wherein the predetermined quantity of radioactive materials are a plurality of intact nuclear fuel rod assemblies, wherein the carrier tube houses the plurality of intact nuclear fuel rod assemblies within the protective-medium.

19. The waste-capsule according to claim 18, wherein the plurality of intact nuclear fuel rod assemblies are housed in the carrier tube in a circle packing configuration, with respect to a cross-section through a diameter of the carrier tube; wherein the waste-capsule further comprises at least one support for supporting the plurality of intact nuclear fuel rod assemblies in the circle packing configuration.

20. The waste-capsule according to claim 18, wherein the plurality of intact nuclear fuel rod assemblies are housed in the carrier tube in a rectilinear packing configuration, with respect to a cross-section through a diameter of the carrier tube; wherein the waste-capsule further comprises at least one support for supporting the plurality of intact nuclear fuel rod assemblies in the rectilinear packing configuration.

21. The waste-capsule according to claim 1, wherein the waste-capsule further comprises at least one support within the carrier tube for supporting the predetermined quantity of radioactive materials in the protective-medium.

22. The waste-capsule according to claim 1, wherein the waste-capsule is inserted into a wellbore, wherein the wellbore is drilled into and located within a deep-geological-formation.

* * * * *